US011773711B2

(12) United States Patent
Maus et al.

(10) Patent No.: US 11,773,711 B2
(45) Date of Patent: Oct. 3, 2023

(54) WELLBORE FRICTION DEPTH SOUNDING BY OSCILLATING A DRILL STRING OR CASING

(71) Applicant: MAGNETIC VARIATION SERVICES LLC, Denver, CO (US)

(72) Inventors: Stefan Maus, Denver, CO (US); Zackary Whitlow, Denver, CO (US); Jin Sun, Denver, CO (US)

(73) Assignee: Magnetic Variation Services LLC, Denver, CO (US)

( * ) Notice: Subject to any disclaimer, the term of this patent is extended or adjusted under 35 U.S.C. 154(b) by 121 days.

(21) Appl. No.: 17/340,457

(22) Filed: Jun. 7, 2021

(65) Prior Publication Data

US 2021/0381361 A1 Dec. 9, 2021

Related U.S. Application Data

(60) Provisional application No. 63/036,573, filed on Jun. 9, 2020.

(51) Int. Cl.
*E21B 44/04* (2006.01)
*E21B 47/09* (2012.01)
(Continued)

(52) U.S. Cl.
CPC ..... *E21B 44/04* (2013.01); *E21B 47/09* (2013.01); *E21B 3/022* (2020.05); *E21B 3/025* (2013.01); *E21B 7/04* (2013.01); *E21B 2200/20* (2020.05)

(58) Field of Classification Search
CPC . E21B 3/022; E21B 3/025; E21B 7/04; E21B 44/04; E21B 2200/20
See application file for complete search history.

(56) References Cited

U.S. PATENT DOCUMENTS

2013/0032401 A1* 2/2013 Edbury ..... E21B 47/003 175/24
2013/0146358 A1* 6/2013 DiSantis ..... E21B 44/02 175/27

(Continued)

FOREIGN PATENT DOCUMENTS

AU 2014264353 B2 9/2016

OTHER PUBLICATIONS

Elgibaly et al., "A Study of Friction Factor Model for Directional Wells", Egyptian Journal of Petroleum, vol. 26, No. 2, Oct. 2016, pp. 1-16.

(Continued)

*Primary Examiner* — Robert E Fuller
*Assistant Examiner* — Lamia Quaim
(74) *Attorney, Agent, or Firm* — Kilpatrick Townsend & Stockton LLP

(57) ABSTRACT

Systems and methods determine friction in a borehole during drilling operations. A drilling system applies oscillatory angular movement at the top of a drill string in a wellbore during drilling by the drilling system, and measures a torque applied to the drill string and an angular position of the drill string. Based on the measured torque and the measured angular position, the drilling system computes a friction between the borehole and the drill string. This can be repeated during drilling of the wellbore to determine multiple friction values, corresponding to various depths of the borehole. Based on the computed friction, the drilling system can perform one or more actions resulting in modified drilling operation. The systems and methods also include oscillating a casing in the borehole, measuring the torque and angular position of the casing, and determining a friction value, which can be repeated to develop a wellbore friction profile.

18 Claims, 14 Drawing Sheets

(51) Int. Cl.

| | |
|---|---|
| *E21B 7/04* | (2006.01) |
| *E21B 3/025* | (2006.01) |
| *E21B 3/02* | (2006.01) |

(56) References Cited

U.S. PATENT DOCUMENTS

| | | | | |
|---|---|---|---|---|
| 2019/0106979 | A1 | 4/2019 | Hadi et al. | |
| 2020/0024901 | A1* | 1/2020 | Shor | E21B 44/04 |
| 2020/0063533 | A1* | 2/2020 | Annaiyappa | E21B 44/00 |

OTHER PUBLICATIONS

Zöllner,"Automated Monitoring of Torque and Drag in Real-Time", Department Mineral Resources and Petroleum Engineering, Drilling Engineering, Sep. 3, 2009, 87 pages.

International Patent Application No. PCT/US2021/036143, "International Search Report and Written Opinion", dated Sep. 10, 2021, 9 pages.

* cited by examiner

WELLBORE FRICTION DEPTH SOUNDING BY OSCILLATING A DRILL STRING OR CASING

CROSS-REFERENCES TO RELATED APPLICATIONS

This application claims the benefit from U.S. Provisional Application No. 63/036,573, filed Jun. 9, 2020, entitled WELLBORE FRICTION DEPTH SOUNDING BY OSCILLATING A DRILLSTRING OR CASING, which is hereby incorporated by reference in its entirety.

BACKGROUND

Field of the Disclosure

The present disclosure provides systems and methods for using a top drive oscillator to probe friction along the wall of a borehole created by a drilling process and determining a corresponding friction coefficient. These systems and methods can then be used to compile a profile of the friction coefficients corresponding to the depth of the borehole in order to optimize the drilling process, mitigate drilling dysfunction, prevent component failures, and improve wellbore quality. The systems and methods can also be used to improve the deployment of borehole casing. The techniques disclosed herein can be implemented using instructions for execution on a processor and can accordingly be executed with a programmed-computer system.

Description of the Related Art

In the oil and gas industry, extraction of hydrocarbon natural resources is done by physically drilling a hole to a reservoir where the hydrocarbon natural resources are trapped. The hydrocarbon natural resources can be up to 10,000 feet or more below the ground surface and be buried under various layers of geological formations. Drilling operations can be conducted by having a rotating drill bit mounted on a bottom hole assembly (BHA) that gives direction to the drill bit for cutting through geological formations and enabled steerable drilling.

Drilling a borehole for the extraction of minerals has become an increasingly complicated operation due to the increased depth and complexity of many boreholes, including the complexity added by directional drilling. Drilling is an expensive operation and errors in drilling add to the cost. In some cases, drilling errors may permanently lower the output of a well for years into the future. Conventional technologies and methods may not adequately address the complicated nature of drilling, and may not be capable of gathering and processing various information from downhole sensors and surface control systems in a timely manner, in order to improve drilling operations and minimize drilling errors.

Slide drilling with a mud motor is a common method used to directionally drill a borehole. During slide drilling, the drill string applies pressure to the bit, which is rotated with the mud motor, but the drill string itself does not rotate. Instead, the drill string slides along the wall of the wellbore with frictional forces acting against it. The frictional forces will vary depending on the coefficient of friction corresponding to the surface of the wellbore wall. The drilling process will also require the drill string to initially overcome a static force of friction that is greater than a dynamic force of friction experienced while the drill string is in motion.

There is a large difference between static and dynamic friction coefficients in drilling a wellbore. Accordingly, it is the static frictional forces that create a strong impediment to achieving sufficient weight on the bit for optimal penetration of the rock.

In order to break static friction, it is common practice to oscillate the angular position of the drill string using the top drive. To minimize static friction, the entire drill string should be in oscillation, but stopping short of the bottom hole assembly, which needs to retain a stable orientation. Industry rules of thumb can provide guidance as to how many wraps forward and backward at which angular velocity are required to oscillate a given length of drill pipe under standard hole conditions.

BRIEF SUMMARY

In some embodiments, a drilling system includes a drill string for drilling a borehole, a top drive coupled to the drill string to provide torque to the drill string, a casing disposed around the drill string, one or more processors, and a memory coupled to the one or more processors. The memory comprises code configured to cause the one or more processors to transmit signals causing a method comprising applying oscillatory angular movement at the top of the drill string or the casing, measuring a torque applied to the drill string and an angular position of the drill string or the casing, based on the measured torque and the measured angular position, computing a friction between the borehole and the drill string, and based on the computed friction, performing an action resulting in modified operation of the drilling system.

In some aspects, computing the friction includes, based on the measured torque and the measured angular position, identifying a modeled torque comprising a reactive torque, a spring torque, and a dynamic torque and determining the friction from a residual between the measured torque and the modeled torque. In some aspects, computing the friction comprises fitting a model to the measured torque to infer one or more of a reactive torque, a spring torque, a dynamic torque, a forward static friction, a reverse static friction, or an average static friction.

In some aspects, taking the action comprises one or more of optimizing a toolface control in sliding; using changes in the friction to identify and mitigate hole cleaning issues, stuck pipe, or tortuosity; using the computed friction to optimize weight on bit and rate of penetration; using the computed friction to apply a modified torque on a bottom hole assembly during rotary drilling; displaying a visualization of the measured torque and the computed friction on a display of the drilling system; or transmitting an alert to an operator.

In some aspects, the torque is measured using a sensor positioned between the top drive and the drill string or the torque is estimated in the top drive based on a measured current. In some aspects, the torque is applied to the drill string and measured via the top drive, the drill string, a quill coupled to the top drive, or a saver sub coupled to the top drive. In some aspects, the method further includes measuring the torque and the angular position at a plurality of times for a plurality of depths of the borehole and computing a corresponding plurality of friction values, wherein the action is based on the plurality of friction values as a function of the respective plurality of depths. In some aspects, computing the friction between the borehole and the drill string or casing comprises computing one or more of: a forward static friction, a reverse static friction, or an average static friction.

In some aspects, the method further includes determining that the friction exceeds a threshold or a target range is not satisfied, wherein the action is performed responsive to determining that the friction exceeds the threshold or the target range is not satisfied. In some aspects, applying the oscillatory angular movement comprises varying both a speed and an amplitude of the top drive, and the method further includes obtaining a plurality of values of torque changes for each of the plurality of speeds and amplitudes of the top drive and generating a profile of friction at depth along a portion of the borehole responsive to the plurality of values of torque changes.

In some embodiments, a method for determining friction in a borehole includes, during drilling of the borehole, applying, by a drilling system, oscillatory angular movement at the top of a drill string or a casing in the drilling system, measuring, by the drilling system during the drilling of the borehole, a torque applied to the drill string and an angular position of the drill string or the casing, based on the measured torque and the measured angular position, computing, by the drilling system during the drilling of the borehole, a friction between the borehole and the drill string or the casing, and based on the computed friction, performing, by the drilling system during the drilling of the borehole, an action resulting in modified operation of the drilling system.

In some embodiments, a non-transitory computer-readable medium includes code configured to cause one or more processors to transmit signals causing a method including during drilling of a borehole, applying, by a drilling system, oscillatory angular movement at the top of a drill string or a casing in the drilling system, measuring, by the drilling system during the drilling of the borehole, a torque applied to the drill string and an angular position of the drill string or the casing, based on the measured torque and the measured angular position, computing, by the drilling system during the drilling of the borehole, a friction between a well bore and the drill string or the casing, and, based on the computed friction, performing, by the drilling system during the drilling of the borehole, an action resulting in modified operation of the drilling system.

Various embodiments are described herein, including methods, systems, non-transitory computer-readable storage media storing programs, code, or instructions executable by one or more processors, and the like.

These illustrative embodiments are mentioned not to limit or define the disclosure, but to provide examples to aid understanding thereof. Additional embodiments are discussed in the Detailed Description, and further description is provided there.

BRIEF DESCRIPTION OF THE DRAWINGS

For a more complete description of the systems and methods of the present disclosure, reference is now made to the following description, taken in conjunction with the accompanying drawings, in which.

DETAILED DESCRIPTION

Figure 1A:
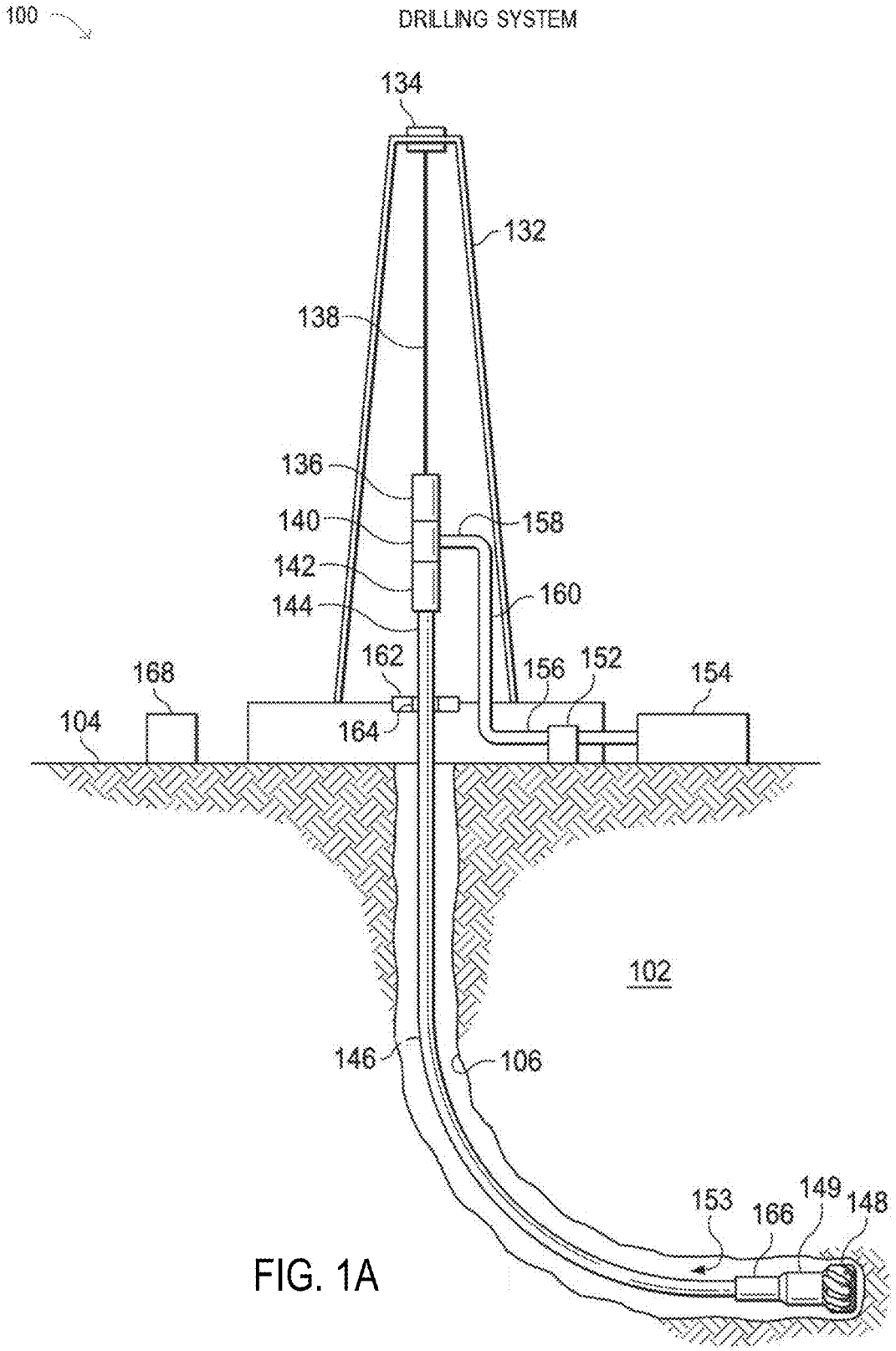
FIG. 1A is a depiction of a drilling system for drilling a borehole.

In the following description, details are set forth by way of example to facilitate discussion of the disclosed subject matter. It is noted, however, that the disclosed embodiments are examples and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

FIGS. 1A-6 illustrate a drilling system 100 according to certain embodiments. Many variations, alternatives, and modifications are possible. For example, in some implementations, the drilling system 100 may have more or fewer subsystems than those shown in FIGS. 1A-6, may combine two or more subsystems, or may have a different configuration or arrangement of subsystems. The various systems, subsystems, and other components depicted in FIGS. 1A-6 may be implemented using hardware, software (e.g., code, instructions, program) executed by one or more processing units (e.g., processors, cores) of the respective systems, or combinations thereof. The software may be stored on a non-transitory storage medium (e.g., on a memory device).

Referring to FIG. 1A, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1A, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating. The top drive 140 may be coupled to a quill, a short section of pipe used to connect the top drive to the drill string 146 (the quill is sometimes referred to as a spindle).

A mud pump 152 may direct a fluid mixture 153 (e.g., a mud mixture) from a mud pit 154 into drill string 146. Mud pit 154 is shown schematically as a container, but it is noted that various receptacles, tanks, pits, or other containers may be used. Mud 153 may flow from mud pump 152 into a discharge line 156 that is coupled to a rotary hose 158 by a standpipe 160. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a top drive oscillator control system 525, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 15), and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166. In some embodiments, steering control system 168 may communicate with a separate controller (not shown) located in downhole tool 166. In particular, steering control system 168 may receive and process measurements received from downhole surveys, and may perform the calculations described herein for surface steering using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 15). Alternatively, at least a portion of the collected data may be stored on a removable storage medium, such as using steering control system 168 or BHA 149, that is later coupled to the database in order to transfer the collected data to the database, which may be manually performed at certain intervals, for example.

In FIG. 1A, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 13), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole toolface/inclination information, downhole tool gamma/resistivity information, economic parameters, reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 1B:
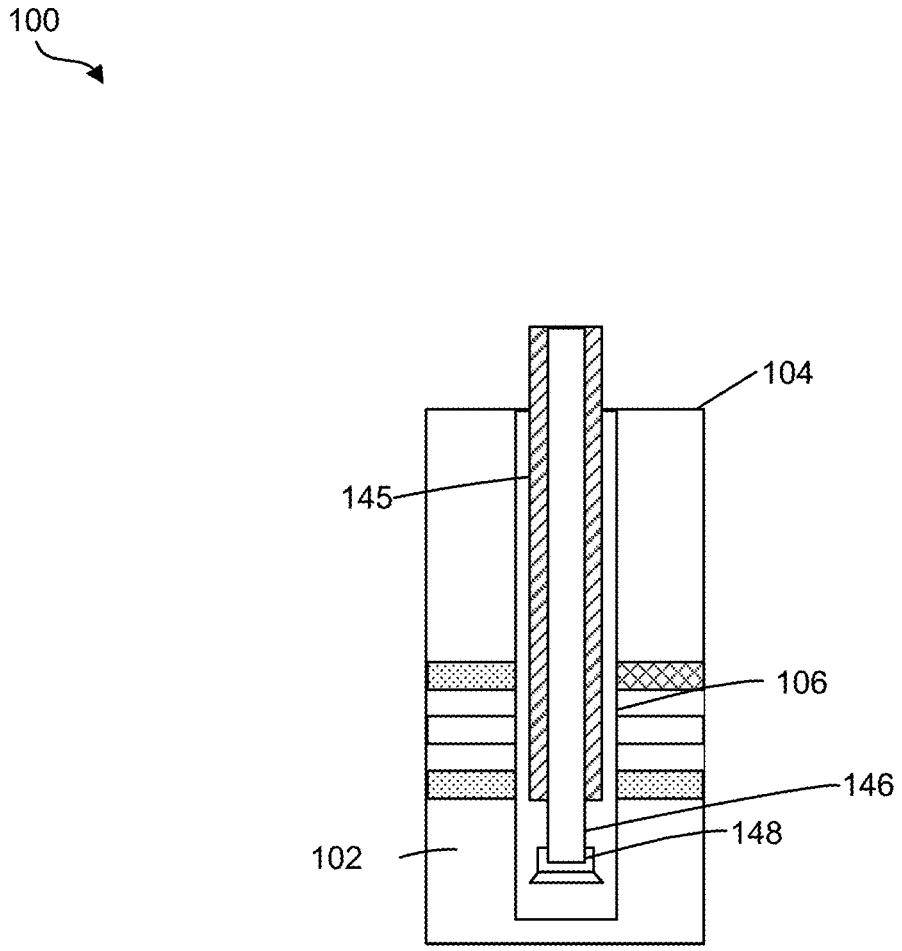
FIG. 1B is a close-up view of a portion of the drilling system of FIG. 1A.

Referring now to FIG. 1B, a close-up view of a portion of the drilling system 100 of FIG. 1A is shown. The drilling system 100 includes a casing 145 (not shown in FIG. 1A) disposed below the surface 104 and around the drill string 146. The casing 145 may be a pipe inserted into the borehole 106. A casing 145 may be placed in the borehole 106 to stabilize the borehole 106 and the surrounding formation 102. Like the drill string 146, the casing 145 can be coupled to the top drive 140 (shown in FIG. 1A), which exerts forces to oscillate and/or generate linear motion in the casing 145.

Figure 2:
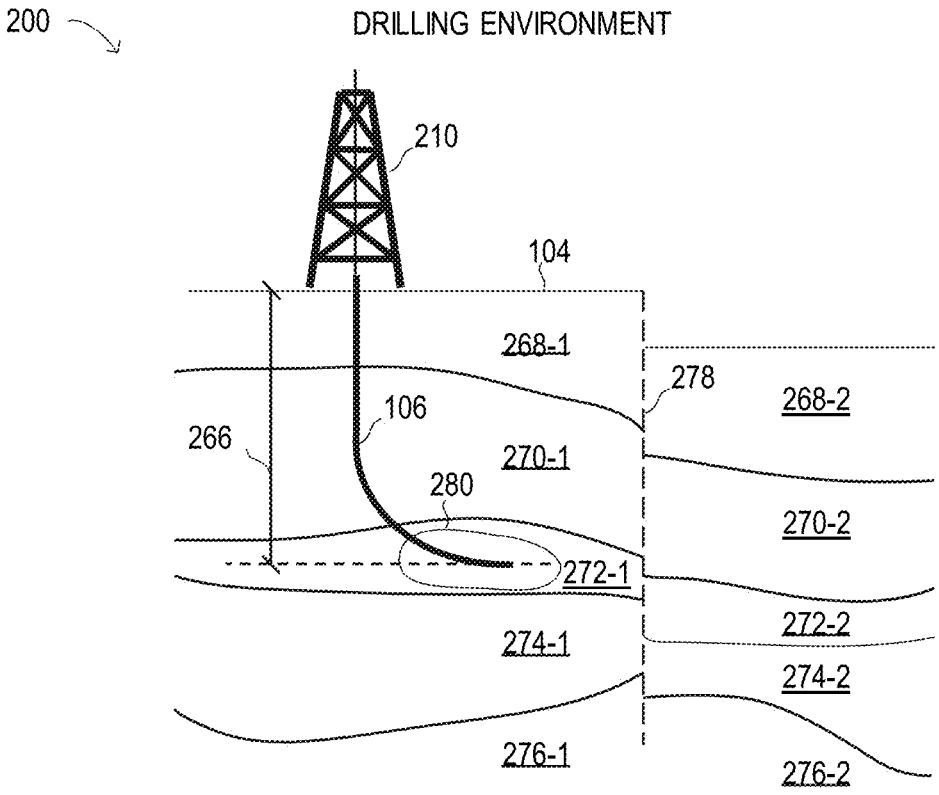
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1A. In FIG. 2, drilling rig 210 may represent various equipment discussed above with respect to drilling system 100 in FIG. 1A that is located at the surface 104.

In drilling environment 200, it may be assumed that a drilling plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drilling plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size, and may be defined using various different methods and information in different embodiments. In some instances, target area 280 may be specified in the drilling plan using subsurface coordinates, or references to certain markers, that indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106, but may involve staying within a strata layer that varies in depth and thickness as illustrated by strata layer 172. As such, directional drilling may involve multiple vertical adjustments that complicate the trajectory of borehole 106.

Figure 3:
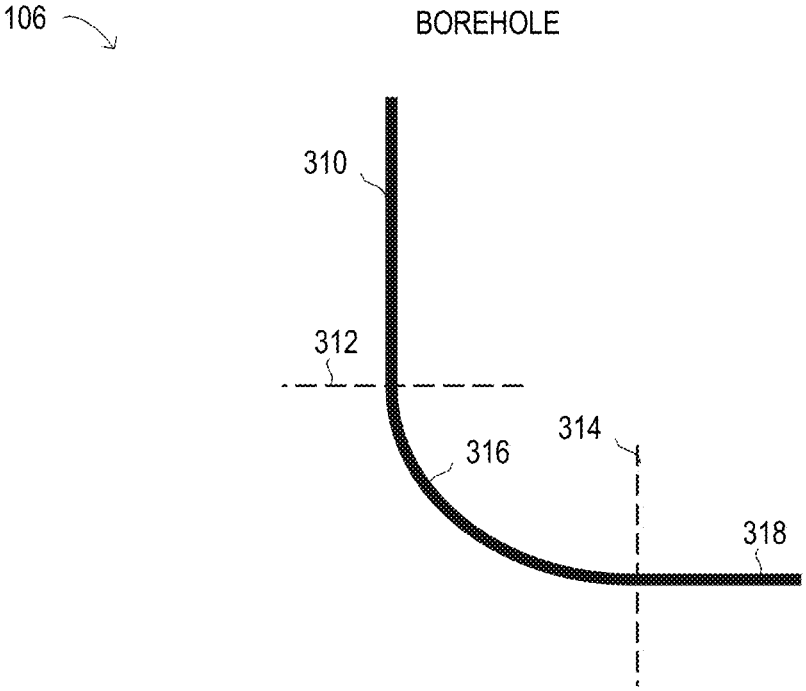
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kick off point 312 in vertical portion 310 and may end at a begin point 314 of horizontal portion 318. The change in inclination in build up section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 148 may be backed out of a portion of borehole 106 and redrilled along a different path. Such mistakes may be undesirable due to the additional time and expense involved. However, if the built rate is too cautious, additional overall time may be added to the drilling process, because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding", are commonly used to form borehole 106. Rotating, also called "rotary drilling", uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates down through the drill string 146 through the mud motor and bit, and back to the surface via the annulus between the drill string 146 and borehole 106 to directionally drill borehole 106 in build up section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, by using the draw works 532 (shown in and described further below with respect to FIG. 5) to control the velocity of the top of the drill string 146 in order to achieve various combinations of pressure or WOB among other adjustments in order to achieve the desired toolface. The adjustments may continue until a toolface is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

In curved or lateral parts of a well, there is increased surface area of the drill string 146 on the surrounding rock, which leads to increased friction and the potential for sticking. When drilling in such a region, the top drive 140 is oscillated, which causes a rocking motion in the drill string 146. This prevents the drill string 146 from sticking.

Figure 4:
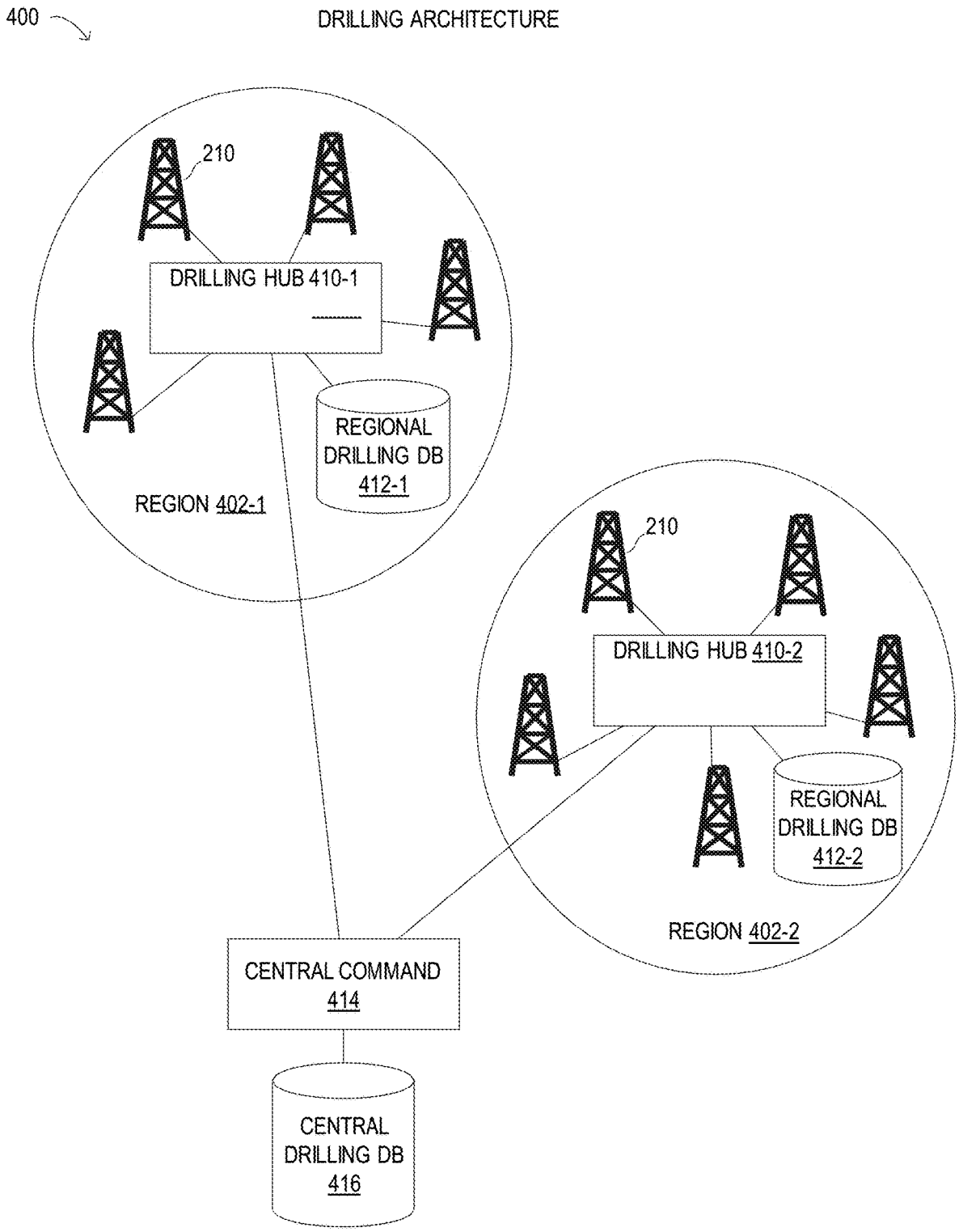
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1A and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402, and may be in different stages of drilling through the depths of formation strata layers at region 402. Thus, for any given well being drilled by drilling rig 210 in a region 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412, or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drilling plan for drilling rig 210 may include processing and analyzing the collected data in regional drilling DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
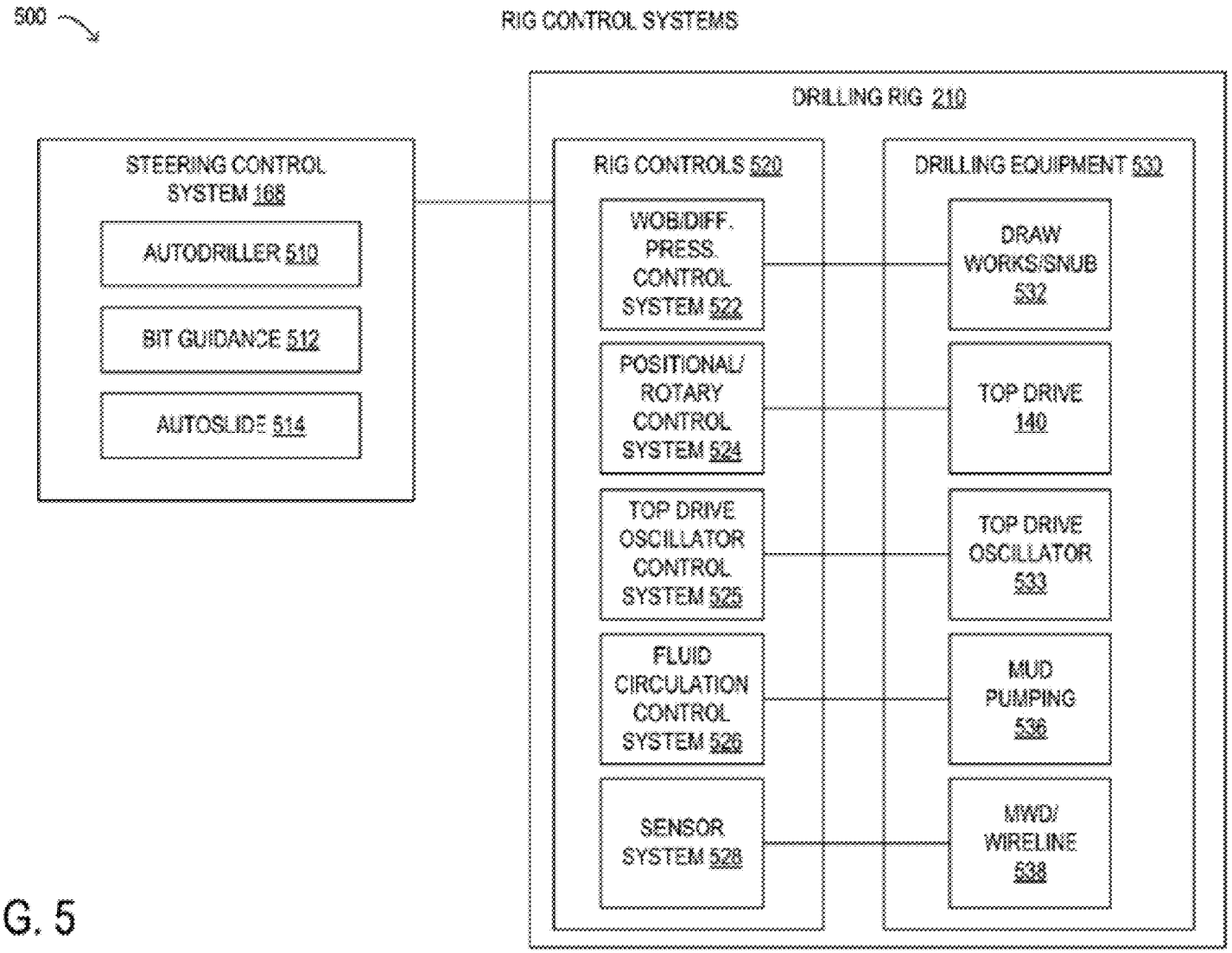
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, a top drive oscillator control system 525, fluid circulation control system 526, and sensor system 528, while drilling equipment 530 includes a draw works/snub 532, top drive 140, a top drive oscillator 533, a mud pumping 536, and an MWD/wireline 538.

Figure 15:
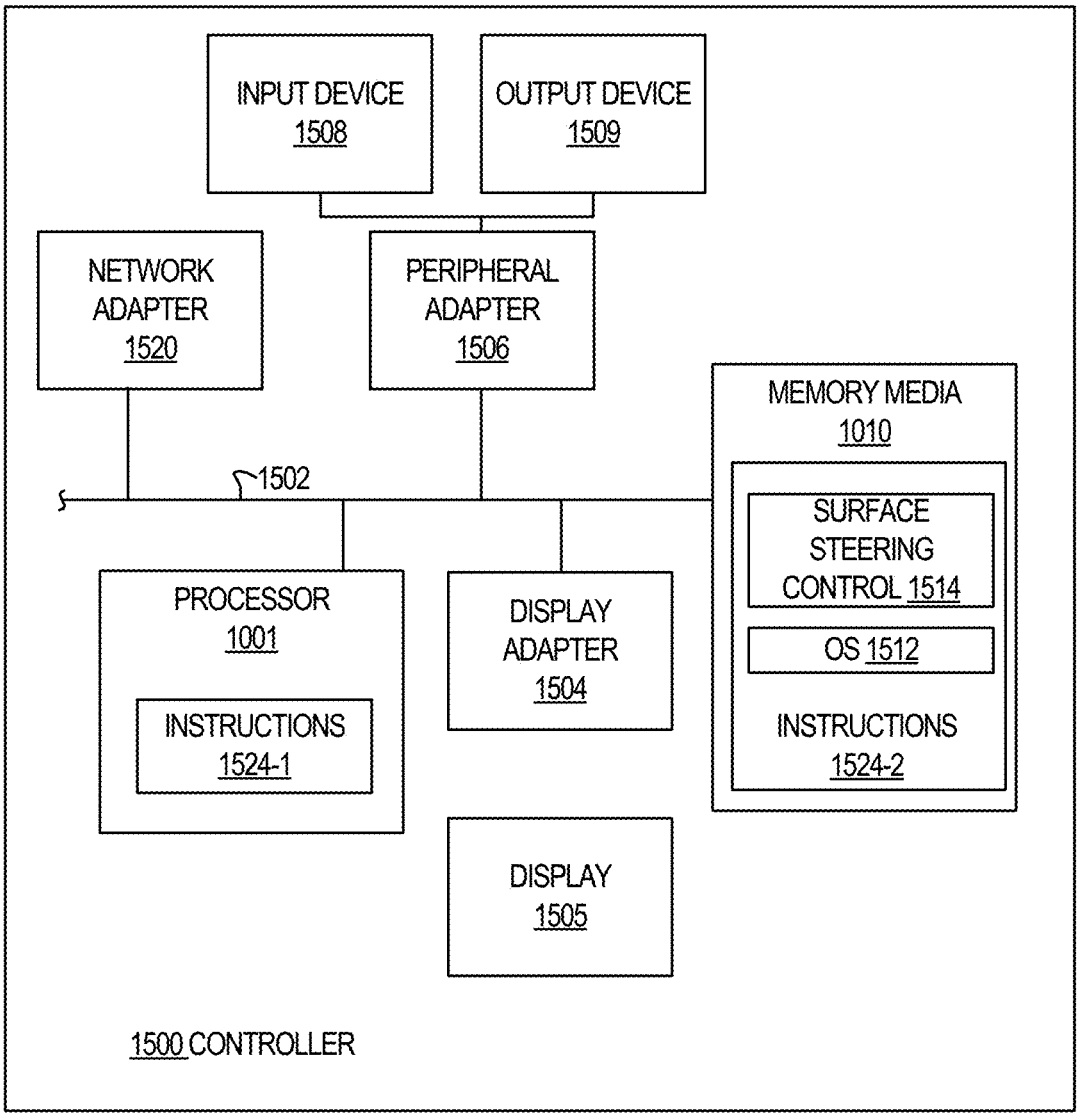
FIG. 15 is a depiction of a controller usable by the rig control systems.

Steering control system 168 represents an instance of a processor having an accessible memory storing instructions executable by the processor, such as an instance of controller 1500 shown in FIG. 15. Also, WOB/differential pressure control system 522, positional/rotary control system 524, a top drive oscillator control system 525, and fluid circulation control system 526 may each represent an instance of a processor having an accessible memory storing instructions executable by the processor, such as an instance of controller 1500 shown in FIG. 15, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling, and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Top drive oscillator control system 525 may be interfaced with top drive oscillator 533 to provide repeated alternating top drive orientation changes with the purpose of reducing the effect of frictional forces on the drill string during sliding. On some rigs, the top drive oscillator control system 525 allows the control of several set points: top drive speed, the amount of clockwise and counter-clockwise rotation, and the neutral position or offset where the oscillation movements are centered. Top drive oscillator control system 525 may further include functionality to identify and record applied torque and other parameters. Top drive oscillator control system 525 may further include functionality to adjust operation based on the friction computations described herein. The top drive oscillator 533 can be used to perform frictional depth sounding wherein friction coefficient is determined along the borehole. In rig control system 500, the top drive oscillator control system 525 can assert a specified torque on the drill string. In addition, rig control system 500 can be configured to control the speed of the drill string rotation or the spindle position.

Fluid circulation control system 526 may be interfaced with mud pumping 536 to control mud flow and may also receive and decode mud telemetry signals. Sensor system 528 may be interfaced with MWD/wireline 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation of drill bit 148.

In rig control systems 500, autoslide 514 may represent an automated slide drilling system and may be used for controlling slide drilling. Autoslide 514 may interface with one or more different control systems on the rig, such as the draw works control system, the top drive orientation control system, and the top drive oscillator control system. Accordingly, autoslide 514 may enable automate operation of rig controls 520 during a slide, and may return control to steering control system 168 for rotary drilling at an appropriate time, as indicated in the well plan. In particular implementations, autoslide 514 may be enabled to provide a user interface during slide drilling to specifically monitor and control the slide. For example, autoslide 514 may rely on bit guidance 512 for orienting a toolface and on autodriller 510 to set WOB or control rotation or vibration of drill string 146.

Figure 6:
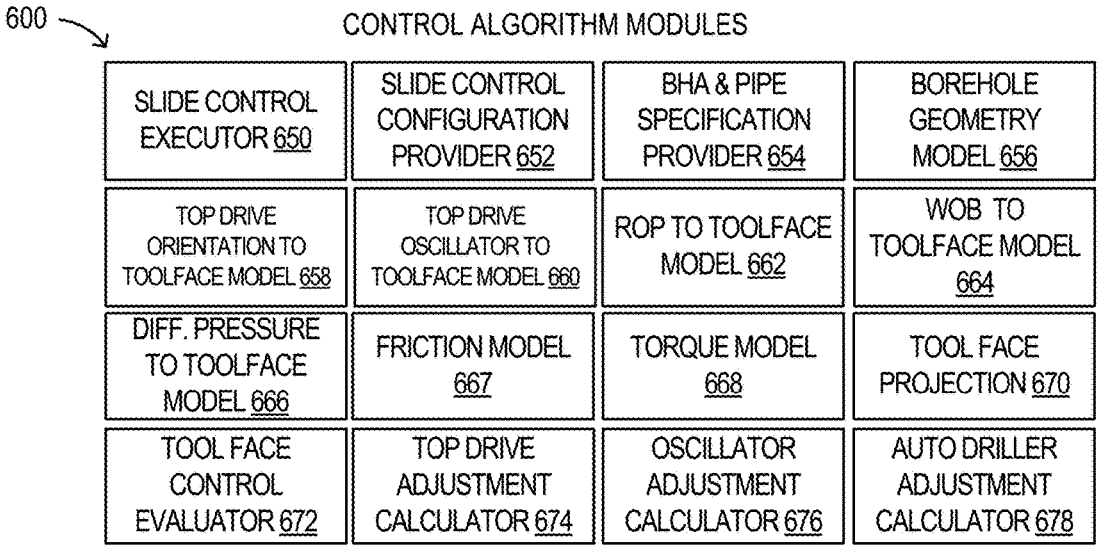
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; an ROP to toolface model 662 that is responsible for modeling the effect on the toolface control of a change in ROP or a corresponding ROP set point; a WOB to toolface model 664 that is responsible for modeling the effect on the toolface control of a change in WOB or a corresponding WOB set point; and a differential pressure to toolface model 666 that is responsible for modeling the effect on the toolface control of a change in differential pressure (DP) or a corresponding DP set point.

The control algorithm modules 600 of FIG. 6 further include a top drive orientation to toolface model 658 that is responsible for modeling the impact that changes to the angular orientation of top drive 140 have had on the toolface control; a top drive oscillator to toolface model 660 that is responsible for modeling the influence that oscillations of top drive 140 has had on the toolface control; and a torque model 668 that is responsible for modeling the comprehensive representation of torque for surface, downhole, break over, and reactive torque, as well as modeling influence of those torque values on toolface control, and determining torque operational thresholds. One or more of the top drive orientation to toolface models 658, top drive oscillator to toolface model 660, and torque model 668 may contribute to a friction model 667 which computes a friction value to perform friction depth sounding as described herein.

The control algorithm modules 600 further include a toolface control evaluator 672 that is responsible for evaluating all factors influencing toolface control and whether adjustments need to be projected, determining whether realignment off-bottom is indicated, and determining off-bottom toolface operational threshold windows; a toolface projection 670 that is responsible for projecting toolface behavior for top drive 140, the top drive oscillator, and auto driller adjustments; a top drive adjustment calculator 674 that is responsible for calculating top drive adjustments resultant to toolface projections; an oscillator adjustment calculator 676 that is responsible for calculating oscillator adjustments resultant to toolface projections; and an autodriller adjustment calculator 678 that is responsible for calculating adjustments to autodriller 510 resultant to toolface projections.

Figure 7:
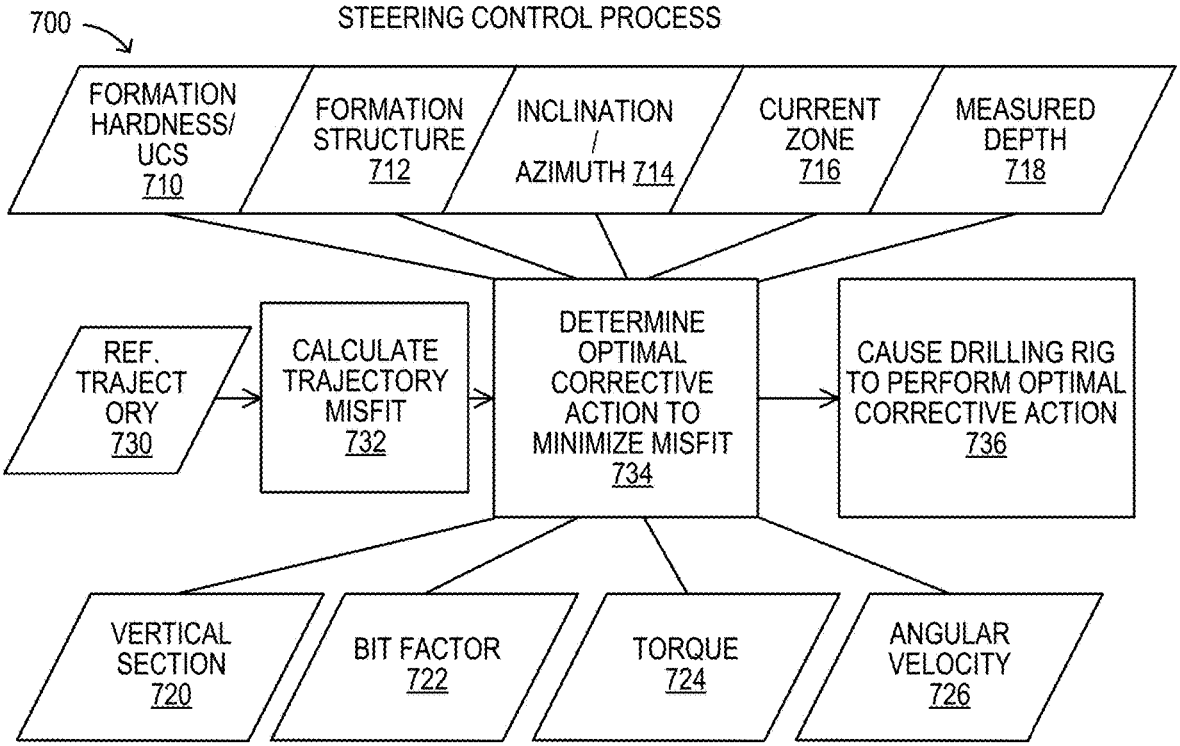
FIG. 7 is a depiction of a steering control process used by the rig control systems.

FIG. 7 illustrates one embodiment of a steering control process 700 for determining a corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired toolface 730, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine a corrective action to minimize the misfit at step 734, which may be performed using the other inputs described above. Then, at step 736, the drilling rig is caused to perform the corrective action.

It is noted that in some implementations, at least certain portions of steering control process 700 may be automated or performed without user intervention, such as using rig control systems 500 (see FIG. 5). In other implementations, the corrective action in step 736 may be provided or communicated (by display, SMS message, email, or otherwise) to one or more human operators, who may then take appropriate action. The human operators may be members of a rig crew, which may be located at or near drilling rig 210, or may be located remotely from drilling rig 210.

Figure 8:
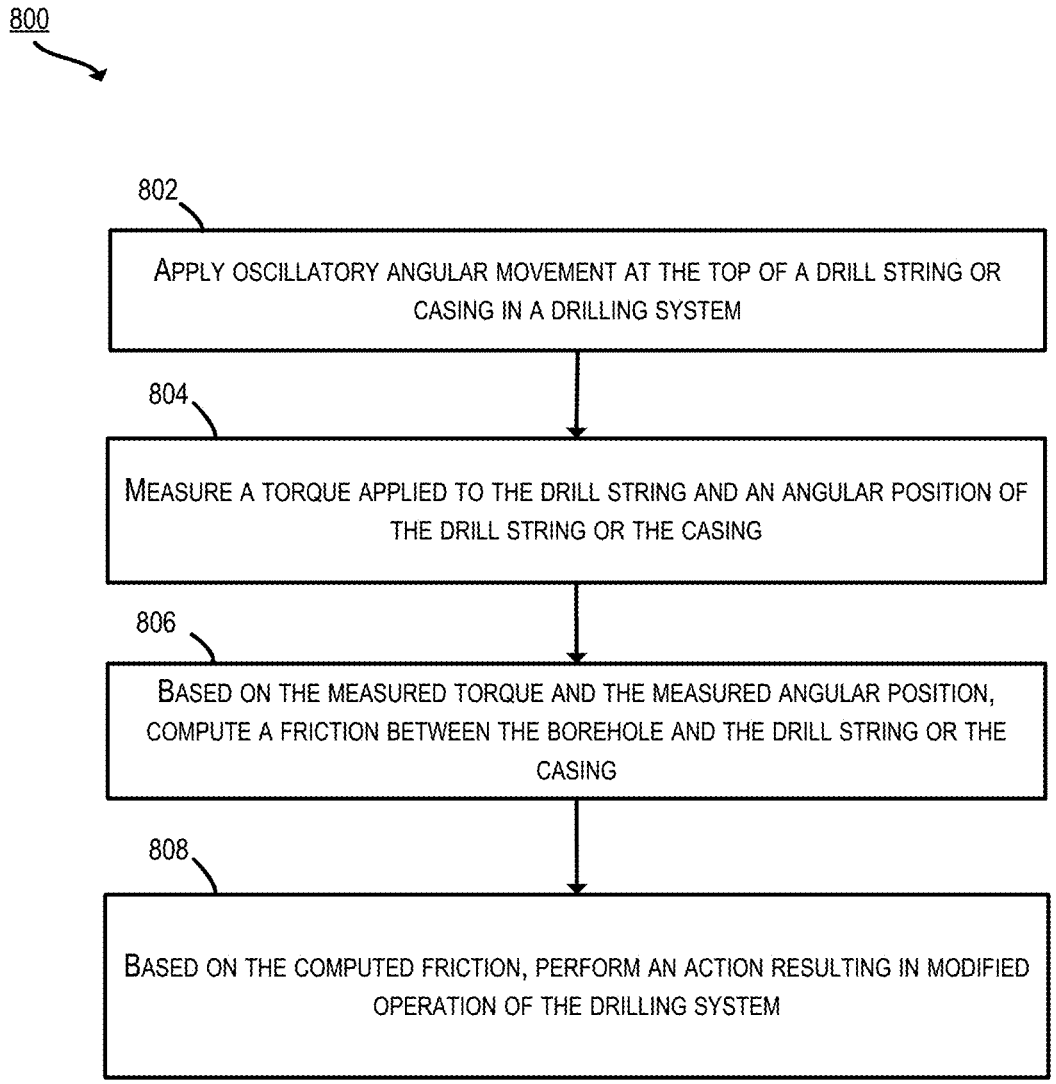
FIG. 8 is a depiction of a method for determining wellbore friction.

FIG. 8 illustrates a method 800 for determining friction in a wellbore by oscillating a drill string or a casing in a drilling system, according to some embodiments. In some implementations, the top drive oscillator control system 525 is used to assert a specified torque on the drill string 146 and/or the casing 145. In addition, rig control system 500 can be configured to control the speed of the drill string rotation or the spindle position, resulting in oscillation of the drill string or casing. The amplitude, speed, and waveform of the oscillation can be exploited to infer the friction between the drill string or casing and the borehole.

At step 802, the top drive oscillator applies oscillatory angular movement at the top of the drill string or casing. The top drive oscillator control system 525 transmits instructions to the top drive oscillator 533, which exerts a torque on the top drive to oscillate the drill string. Alternatively, or additionally, the top drive oscillator applies angular movement to the top drive to oscillate the casing. In some implementations, the top drive oscillator control system imposes controlled variations in the speed of angular motion of the drill string and/or casing. Alternatively, or additionally, the top drive oscillator control system adds oscillations in speed to a constant rotational speed for different oscillation speeds and periods.

In some aspects, the top drive is programmed and used to excite a torsional movement of the drill string that extends along its length and down into the wellbore. The longer the period and the larger the amplitude, the deeper this torsional movement should extend along the drill string and down the borehole. For example, a rapid small amplitude movement may only penetrate a few hundred feet, while a long period, large amplitude oscillation may extend all the way along the length of the drill string to the bit.

In some embodiments, the top drive oscillator is controlled to vary the speeds and amplitudes of the angular motion of the drill string at a plurality of intervals during the drilling of a well. In other words, in some implementations, applying the oscillatory angular movement includes varying both a speed and an amplitude of the top drive. For example, the control system of the drilling rig can be programmed to sweep through a pre-programmed set of speeds and amplitudes of the top drive oscillator at each stand for one or more portions of the wellbore or the entire wellbore of a well being drilled. In some implementations, oscillations are attenuated with increasing depth of the hole. For example, the top drive oscillates the drill string +/−4 revolutions initially, reduces the oscillation rate to +/−2 revolutions at 10,000 feet deep, and zero amplitude beyond 15,000 feet. Accordingly, the applied oscillations may vary with depth and/or time.

At step 804, the rig control system (e.g., the top drive oscillator control system) measures a torque applied to the drill string and an angular position of the drill string or the casing. The torque may be applied to the drill string via the top drive and is also referred to herein as the "top drive torque." In some implementations, the torque is estimated in the top drive based on a measured current. Alternatively, or additionally, the rig control system measures the torque using a sensor positioned between the top drive and the drill string. Alternatively, or additionally, the torque may be applied to the drill string and measured via the drill string, the quill, and/or the saver sub.

The rig control system also measures an angular position of the drill string by determining the angular position of a fixed point on the drill string (also referred to as the "spindle position"). Alternatively, or additionally, the rig control system measures the angular position of a fixed point on the casing.

In some embodiments, steps 802 and 804 are repeated at a series of different times. This results in time-series data including a plurality of torque values, a plurality of angular position values, and a plurality of corresponding time values. For example, the spindle position and torque are measured at a relatively high rate (e.g., at a cadence of about 0.06 seconds).

At step 806, based on the measured torque and the measured angular position, the drilling system (e.g., using the friction model 667 in cooperation with other control algorithm modules 600) computes a friction (e.g., a coefficient of static friction) between the borehole and the drill string or the casing. In some embodiments, the drilling system computes the friction by fitting one or more of the values measured at step 804 to a model.

The motion of the top drive in concert with the pipe string and the BHA ("top drive-string-BHA system") can be affected by many physical parameters, including friction of static and dynamic nature, string inertia and spring coefficients, reactive torque from the BHA, and so forth. These factors may be time-dependent, distributed across the physical system, and may affect the system function in a nonlinear way. In some embodiments, the system inference tasks are considered from an input-output point of view, where the top drive-string-BHA system is modelled as a general, nonlinear, time-variant, non-Markovian system. For example, the model takes the time series of top drive torque as input, and the time series of top drive position as the output, or vice-versa. The structure of the system model can be determined from the physical considerations, with simplifying assumptions. The model may be described by physical parameters and hyperparameters, including parameters that characterize the frictional profiles of the system, and more. The system inference problem thus becomes a system identification problem, where the system parameters are estimated from the observed input-output time series, which in turn gives the frictional profiles as well as other physical quantities of interest. The friction depth sounding method can be used during drilling, where the friction coefficient profile represents the interaction between the drill string and the hole. Alternatively, or additionally, the friction depth sounding method can be used during the deployment of casing where the friction coefficient profile represents the interaction between the casing and the hole, rather than the drill string and the hole.

In some implementations, the model of top drive torque $T_{topdrive}$ is:

$$T_{topdrive}=-T_{reactive}+k_{spring}S(t)+k_{dynamic}S'(t)+F_{static}(S'=0)+k_{inertia}S''(t) \quad [1]$$

where $T_{topdrive}$=modeled top drive torque;

$T_{reactive}$=reactive torque from bit/rock interaction;

S(t), S'(t), S"(t)=spindle position (deg), velocity (deg/s) and acceleration (deg/s$^2$);

$k_{spring}$=spring coefficient of twisting the drill string;

$k_{dynamic}$=coefficient of dynamic torque;

$F_{static}$=coefficient of static friction when velocity is small; and $k_{inertia}$=coefficient of inertia of drill string.

The top drive torque $T_{topdrive}$ has diagnostic value during sliding. A spring torque needed to twist the drill string is given by the component $k_{spring}S(t)$. A dynamic torque is given by the component $k_{dynamic}S'(t)$, and explains an additional trend with spindle velocity. There is also an unmodeled residual torque at low spindle velocity, which provides an accurate estimate of the static friction coefficient (also referred to herein simply as the friction) $F_{static}$.

Figure 10:
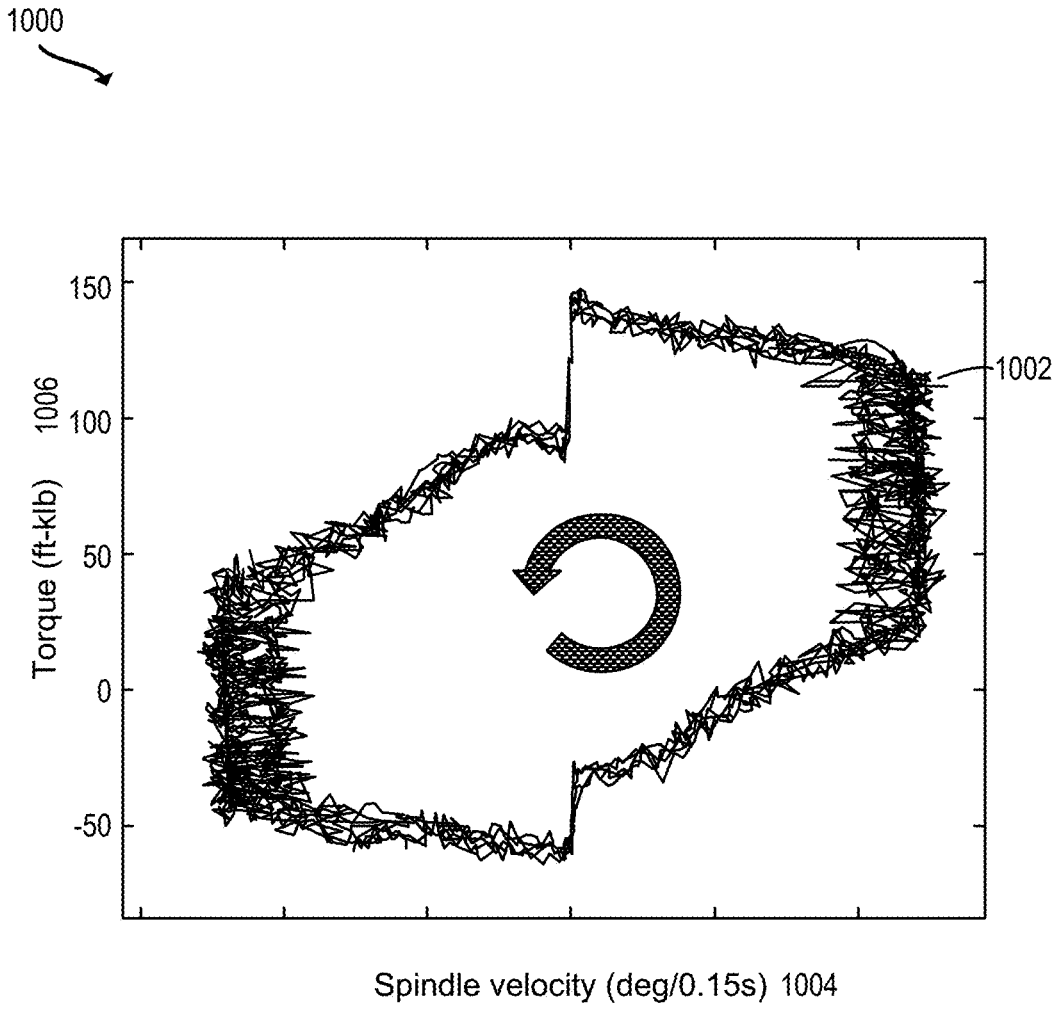
FIG. 10 is a depiction of a hysteresis loop in top drive torque over several oscillations.

Each of the above contributions to the torque increases with measured depth, and these torque components generally vary with the depth at different rates. The drilling system identifies these terms, including a reactive torque, a spring torque, and a dynamic torque, from parameters of the model. The inertia term may be difficult to resolve if inertia is small. To address this in cases of small inertia values, the effect of inertia may also be included in the other model terms, such as the dynamic torque. The model parameters can be estimated continuously in real time. The spindle position S(t) and the and the top drive torque T(t) measured at step 804 are used as input parameters to the model. An example of these two parameters is shown in FIG. 10.

Figure 11:
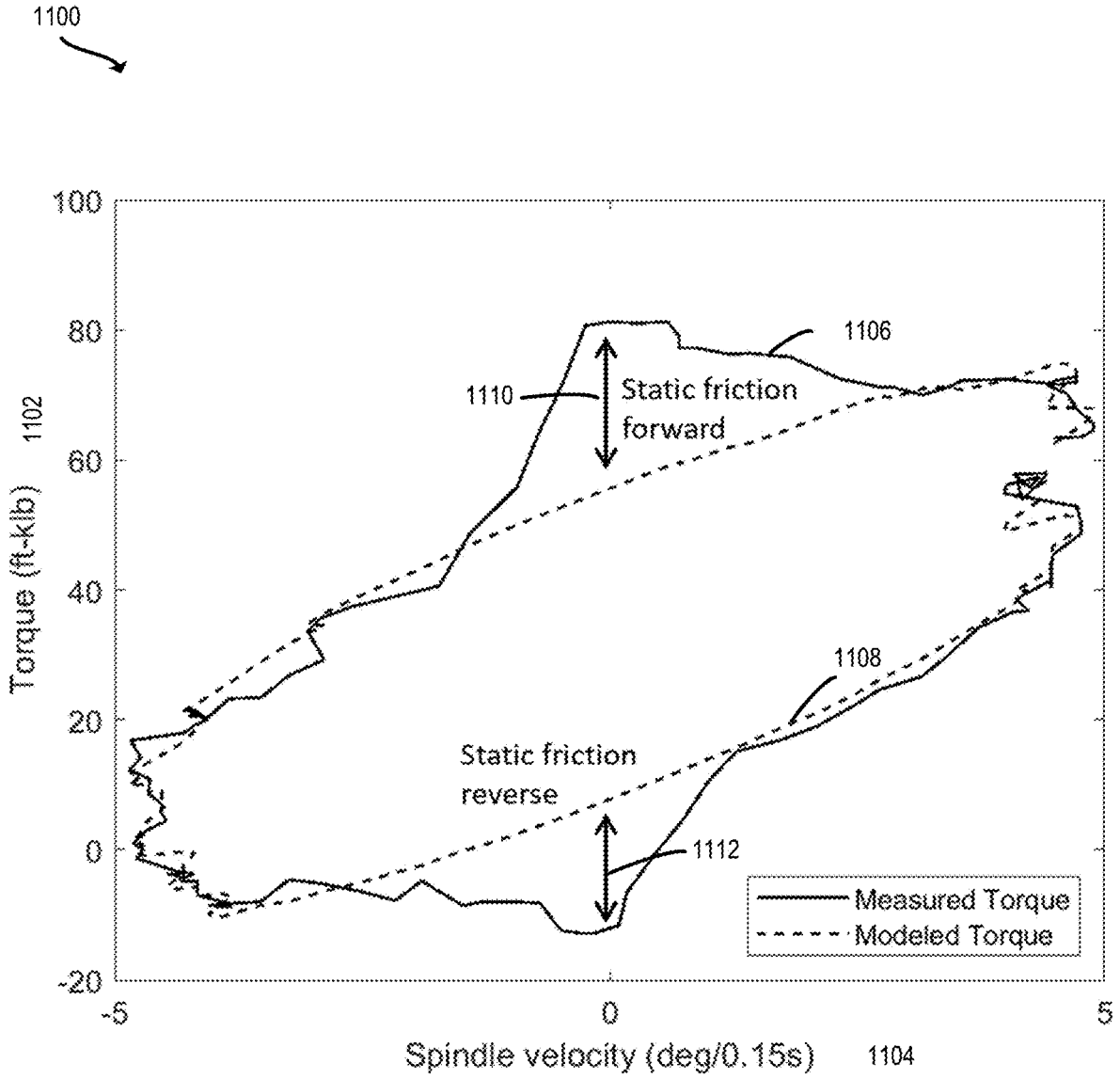
FIG. 11 is a depiction of a graph illustrating a technique for determining friction based on modeled torque and measured torque in a drilling system.

In some implementations, the drilling system computes the spindle velocity (the velocity of a fixed point on the drill string or casing) by numerically estimating the first time derivative S'(t). The first time derivative may, for example, by numerically estimated using finite differences. An example of the torque plotted against the spindle velocity for multiple oscillations is shown in FIG. 11.

The drilling system divides the time series data of the spindle position into single oscillations, for example from one minimum in the spindle position to the next minimum. This corresponds to one full hysteresis loop, including a period of forward rotation and a corresponding period of reverse rotation (e.g., as indicated by the solid line in FIG. 11).

The drilling system fits a simplified model $$T_{topdrive}=-T_{reactive}+k_{spring}S(t)+k_{dynamic}S'(t) \quad [2]$$

to one oscillation of T(t), S(t) and S'(t). The best-fitting model provides a set of optimal values for the parameters $T_{reactive}$, $k_{spring}$ and $k_{dynamic}$. Thus, the drilling system identifies a modeled torque including a reactive torque, a spring torque ($k_{spring}S(t)$), and a dynamic torque ($k_{dynamic}S'(t)$).

Static friction in the forward and reverse direction is seen as the difference between the measured torque and the best-fitting simple model at zero velocity (as illustrated in FIG. 11). Subtracting the simple model from the observed torque gives the residual torque. The maximum of the residual torque provides an estimate of the static friction in the forward direction. The minimum of the residual gives an estimate of the negative of the static friction in the reverse direction. (See forward static friction 1110 and reverse static friction 1112 shown in FIG. 11). Thus, the drilling system determines the friction from a residual between the measured torque and the modeled torque.

In some implementations, the forward static friction and reverse static friction are computed as the minimum and maximum of the residual between the modeled torque and the measured torque. For example, the static friction is computed as the average of the forward and reverse static friction. Thus, in some aspects, computing the friction between the borehole and the drill string or casing comprises computing a forward static friction, a reverse static friction, and an average static friction.

Although the above example provides one model for determining friction from the applied torque, other implementations are possible. As an example, in some embodiments, rather than fitting the measured parameters to a model without a friction component and computing the residual friction as described above, the model can include the friction (e.g., average static friction, forward static friction and/or reverse static friction) as parameters. In some embodiments, computing the friction includes fitting a model to the measured torque to infer a reactive torque, a spring torque, a dynamic torque, a forward static friction, a reverse static friction, and an average static friction. In this case, the model may be similar to Equation [1] above, but with one or more additional friction components.

Figure 12:
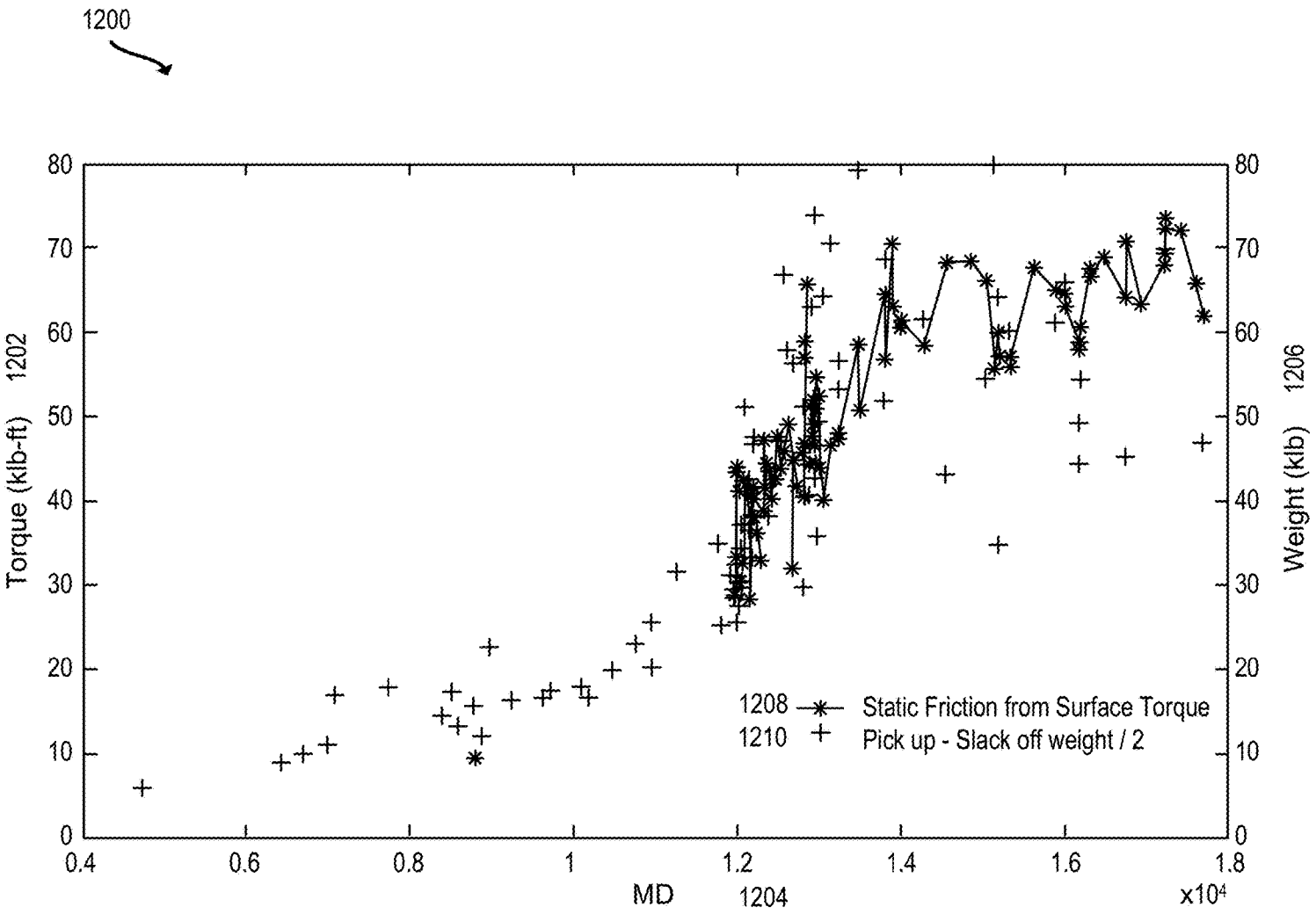
FIG. 12 is a depiction of a graph illustrating static friction as computed using the techniques of the present disclosure, as compared to static friction determined using pick-up slack-off weight.

In some embodiments, in addition to computing the friction, further information on subsurface conditions are inferred. For example, changes in hook load, fluid pressure, and block velocity caused by top drive oscillations of varying speed and amplitude can also be measured. Alternatively, or additionally, the static friction estimates $F_{static}$ can further be calibrated or validated against independent pick-up slack-off friction estimates, as shown in FIG. 12.

In some implementations, the drilling system performs friction depth sounding at regular intervals. For example, friction measurements are repeated at regular time or depth intervals, such as at every stand or at a plurality of stands. After measuring the torque and the angular position at a plurality of times for a plurality of depths of the borehole at step 804, the drilling system computes a corresponding plurality of friction values. This approach can be used to obtain a time series of friction-with-depth profiles for each depth, such as one depth friction profile with every stand.

Alternatively, or additionally, the drilling system computes a friction profile at a set of depths based on torque changes. Based on the torque values and the speed and amplitude of the top drive identified at step 804, the drilling system obtains a plurality of values of torque changes for each of the plurality of speeds and amplitudes of the top drive. For example, the drilling system subtracts sequential or otherwise selected torque values. The drilling system then generates a profile of friction at a set of depths along a portion of the borehole responsive to the plurality of values of torque changes.

Repeated friction depth sounding in regular intervals along the wellbore can be used to monitor changes in friction along the wellbore as an early warning of hole integrity and hole cleaning issues, helping to prevent stuck pipe and other anomalous conditions requiring early detection and remedial action. Repeating the friction depth sounding is also useful in that the friction of a measurement could change for various reasons. For example, an increase in a friction measurement might occur because the new stand has greater friction, or it could increase because a hole cleaning issue has developed. With a time series of repeated depth soundings, the difference between changes of friction with depth and changes in friction over time can be resolved. Alternatively, or additionally, the friction profile over depth and/or time can be predicted based on recorded measurements from prior drilling sessions in a same or similar wellbore.

Friction depth sounding can be carried out when the bit is off bottom and when it is on bottom. Friction generally increases with the WOB because of higher side forces at the contact points. Ideally, friction depth sounding is determined for a value of the WOB that is close to the value used in drilling. Friction depth sounding is useful for all modes of drilling, including rotary drilling, slide drilling and rotary steerable drilling. It can be carried out between stands or during drilling of a stand.

As noted above with respect to step 802, in some embodiments, the top drive oscillator is controlled to vary the speeds and amplitudes of rotation of the drill string at a plurality of intervals. The drilling system may then determine the coefficient of friction of the drill string at the depth of each interval. For each depth at which the values of the coefficient of friction are determined that correspond to each of the plurality of speed and amplitude variations, a coefficient of friction profile can be generated and then these may be combined to provide a more detailed friction profile.

As noted above, in some implementations, the spindle position, velocity, and torque are observed at a high data rate (e.g., at a cadence of about 0.06 seconds). Directly interpreting this high-rate data would be difficult. To address this, high-rate data is processed one oscillation cycle at a time (e.g., at a cadence of about 30 seconds) to determine friction and reactive torque. These meaningful parameters can be monitored, displayed and interpreted in real time.

In some implementations, the parameters can be interpreted further using a torque and drag model or a drilling simulator, which accounts for the properties of the top drive, drill string, BHA and bit/rock interaction. The interpretation can further take the tortuosity of the wellbore trajectory and geological formation properties into account.

At step 808, based on the computed friction, the rig control system performs an action resulting in modified operation of the drilling system. The friction computed at step 806 (and potentially other parameters) are used to take actions to optimize the drilling process, improve wellbore quality, prevent component failures and/or mitigate drilling dysfunction.

In some embodiments, an action is executed based on a threshold or target range. At an initial time, such a threshold or range can be configured. Then, upon computing the friction at step 806, the drilling system compares the computed friction to the threshold. If the drilling system determines that the friction exceeds a threshold or a target range is not satisfied, then the action may be performed responsive to determining that the friction exceeds the threshold or the target range is not satisfied. For example, if a friction increase exceeds a threshold therefor or falls outside a target range therefor, the drilling system is programmed to automatically alert an operator and send one or more appropriate control signals to adjust one or more drilling parameters to adjust drilling operations. Alternatively, or additionally, the drilling system determines to take an action based on the overall friction profile (e.g., a plurality of friction values as a function of the respective plurality of depths).

Based on one or more friction values, the drilling system identifies one or more actions to perform. The drilling system may identify and mitigate issues such as sticking, and/or optimize drilling parameters such as toolface control, hook load, block velocity, pump rate and top drive torque in order to improve drilling and casing running performance.

As an example, the rig control system modifies operation of the drilling system to optimize a toolface control in sliding. The computed friction can be used to change the spindle position over time in order to optimally control the toolface. The toolface is an angle measured between a reference direction on the drill string and a fixed reference (e.g., north for a magnetic toolface or the top of the borehole for a gravity toolface). The toolface can be optimized using the computed friction. As a specific example, a mud motor with a bend is used to drill a curved section of a wellbore. The orientation of the bend is monitored using toolface measurements by the Measurement While Drilling (MWD) tool, which are transmitted by mud pulse telemetry to the surface. If the actual toolface is found to deviate from the desired toolface, the mean spindle position and block velocity are adjusted to correct the toolface. The amount of angular adjustment of the spindle position needed to achieve the desired change in the toolface at a given block velocity depends on the friction coefficient of the wellbore. The higher the coefficient of friction, the larger the required angular adjustment in the spindle position and the longer time it takes the angular change to migrate downhole and take effect. Knowledge of the friction coefficient during slide drilling therefore enables applying the most effective change in spindle position over time to optimally control the toolface.

As another example, modifying operation of the drilling system includes optimizing the weight on bit (WOB), which is important for efficient drilling. The value of the optimal WOB can be determined from prior experience and engineering specifications. During drilling, the WOB is estimated from the negative difference between hook load and a tare value of the hook load previously taken with the bit off bottom. Using the tared hook load is meant to compensate for friction. However, the friction coefficient may change during drilling of a stand. Consequently, the actual WOB is different from the one given by the tared hook load. Monitoring the friction during drilling enables compensating for changes in the actual WOB. For example, if the friction factor is seen to increase during drilling, it means that the WOB must be decreasing if the same hook load is maintained. In order to counteract this undesired decrease in WOB, the drilling system can then increase the block velocity, which decreases the hook load, imposing a larger weight onto the bit.

As another example, modifying operation of the drilling system includes using the computed friction to apply a modified torque on a bottom hole assembly (BHA) during rotary drilling. During rotary drilling, an increase in borehole friction means that less of the top drive torque is applied to the BHA. Without knowing the friction coefficient, one may hesitate to increase the block velocity and increase the top drive torque out of fear of exceeding the maximum allowable torque on the BHA. On the other hand, if the friction coefficient is measured using the disclosed method, one can estimate the torque lost along the wellbore and can safely increase the block velocity and top drive torque to apply the desired amount of torque onto the BHA.

As another example, modifying operation of the drilling system includes identifying and mitigating issues such as hole cleaning issues, stuck pipe, or tortuosity, using the computed friction to optimize weight on bit and rate of penetration. During drilling, one might notice an increase in the friction coefficient. This could have a number of different causes, including (1) build-up of cuttings necessitating a hole cleaning cycle, (2) borehole instability, (3) increased borehole tortuosity, (4) buckling of the drill string or (5) penetration of a sticky formation. Depending on the most likely cause, one can take the appropriate mitigating action or make other use of this information.

Figure 13:
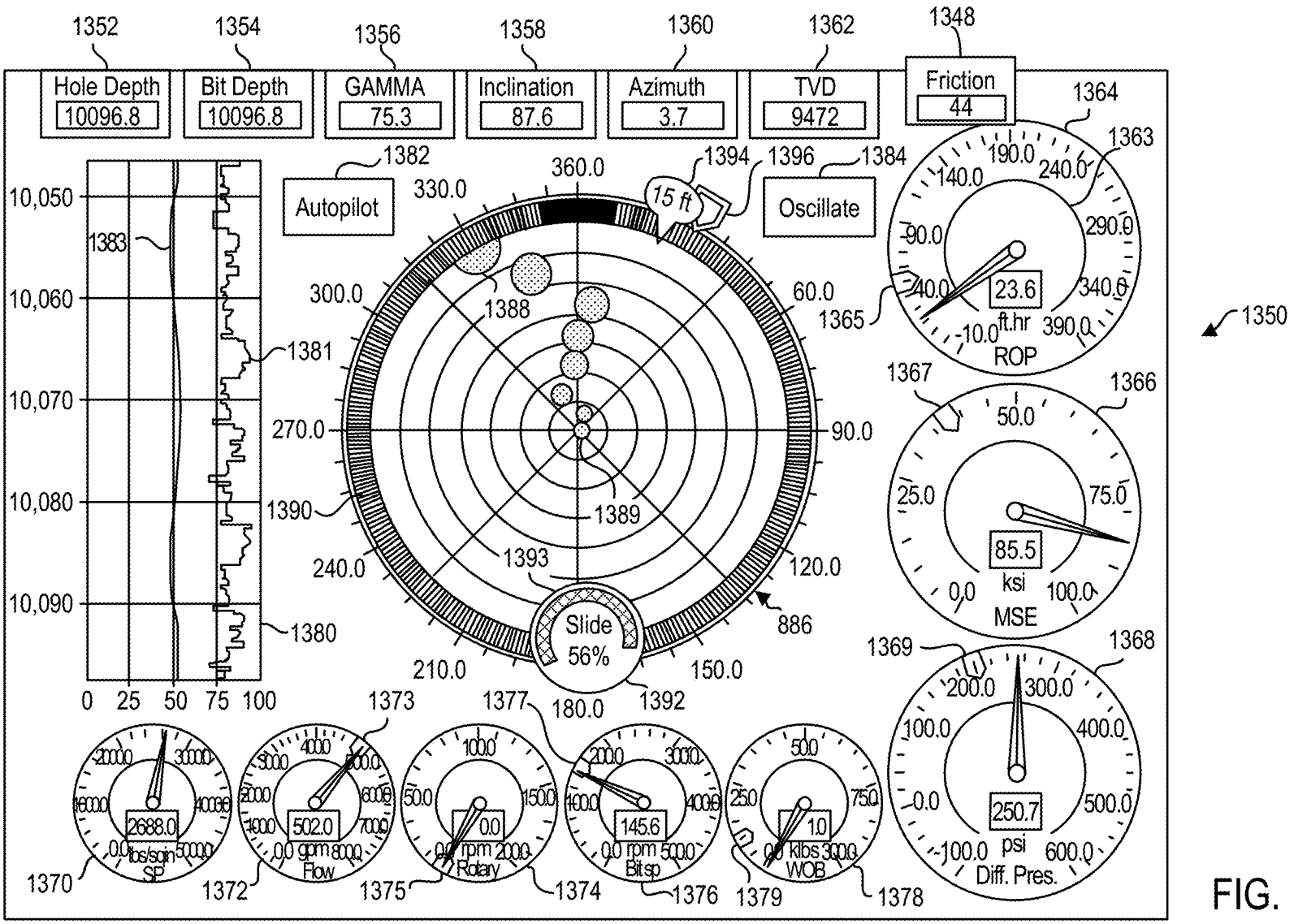
FIG. 13 is a depiction of a graphical user interface provided by the rig control systems.

In some implementations, some or all of the computed information is displayed to an operator (e.g., via a display of the drilling system, such as the user interface 1350 shown in FIG. 13). For example, the drilling system displays a visualization of the measured torque and the computed friction on the display of the drilling system. This can be in numerical form and/or graphical form (e.g., via a graph such as that illustrated in FIGS. 10 and 11. Alternatively, or additionally, the estimates of $T_{reactive}$, $k_{spring}$, $k_{dynamic}$, and $F_{static}$ can then be displayed as a profile with measured depth. In some implementations, all contributions can be scaled to torque units, by displaying $T_{reactive}$, $k_{spring}S_{max}$, $k_{dynamic}V_{max}$, and $F_{static}$.

In some implementations, the action performed includes transmitting an alert to an operator. For example, the drilling system emits an audio alert. As other examples, the drilling system transmits an electronic mail (email) or text message to the operator. For example, the alert includes the text "Warning—friction over threshold" or "Warning—sudden change in friction detected." Upon viewing displayed friction information and/or receiving an alert, an operator may interact with the drilling system to modify operations.

Knowledge of the friction profile along the wellbore has several practical benefits to optimize the drilling process, such as enabling an accurate modeling of the dynamic behavior of the drill string. Repeated friction depth sounding in regular intervals along the wellbore can be used to monitor changes in friction along the wellbore as an early warning of hole integrity and hole cleaning issues, helping to prevent stuck pipe and other anomalous conditions requiring early detection and remedial action. The friction profile can further be used to enable accurate estimation of WOB, which is critical for achieving maximal ROP, avoiding motor stalls related to excessive WOB, avoiding excessive bit wear, minimizing Mean Specific Energy required to cut the rock, avoiding stick slip and parameter regimes that produce excessive vibration. Moreover, knowledge of the friction profile can guide hole improvement operations during drilling (e.g. reaming). Knowledge of the friction coefficient can be used to optimize toolface control in slide drilling. Further, knowledge of the friction profile along the wellbore can provide information for running casing. During deployment of casing, this invention may further be used to determine the depth profile of the friction between the casing and the hole. Monitoring changes in the friction profile over time, providing early identification of adverse hole conditions which require remedial action. Estimating friction coefficients from the top drive torque enables continuous monitoring of wellbore friction during sliding without lifting off bottom.

In some implementations, the method 800 is performed during drilling before completion. The casing may not be disposed around the drill string, and the drilling system includes a drill string for drilling a borehole, a top drive coupled to the drill string to provide torque to the drill string, one or more processors, and a memory coupled to the one or more processors, the memory comprising code configured to cause the one or more processors to transmit signals causing a method. The method includes applying oscillatory angular movement at the top of the drill string, measuring a torque applied to the drill string and an angular position of the drill string, based on the measured torque and the measured angular position, computing a friction between the borehole and the drill string; and based on the computed friction, performing an action resulting in modified operation of the drilling system, as described above.

Figure 9:
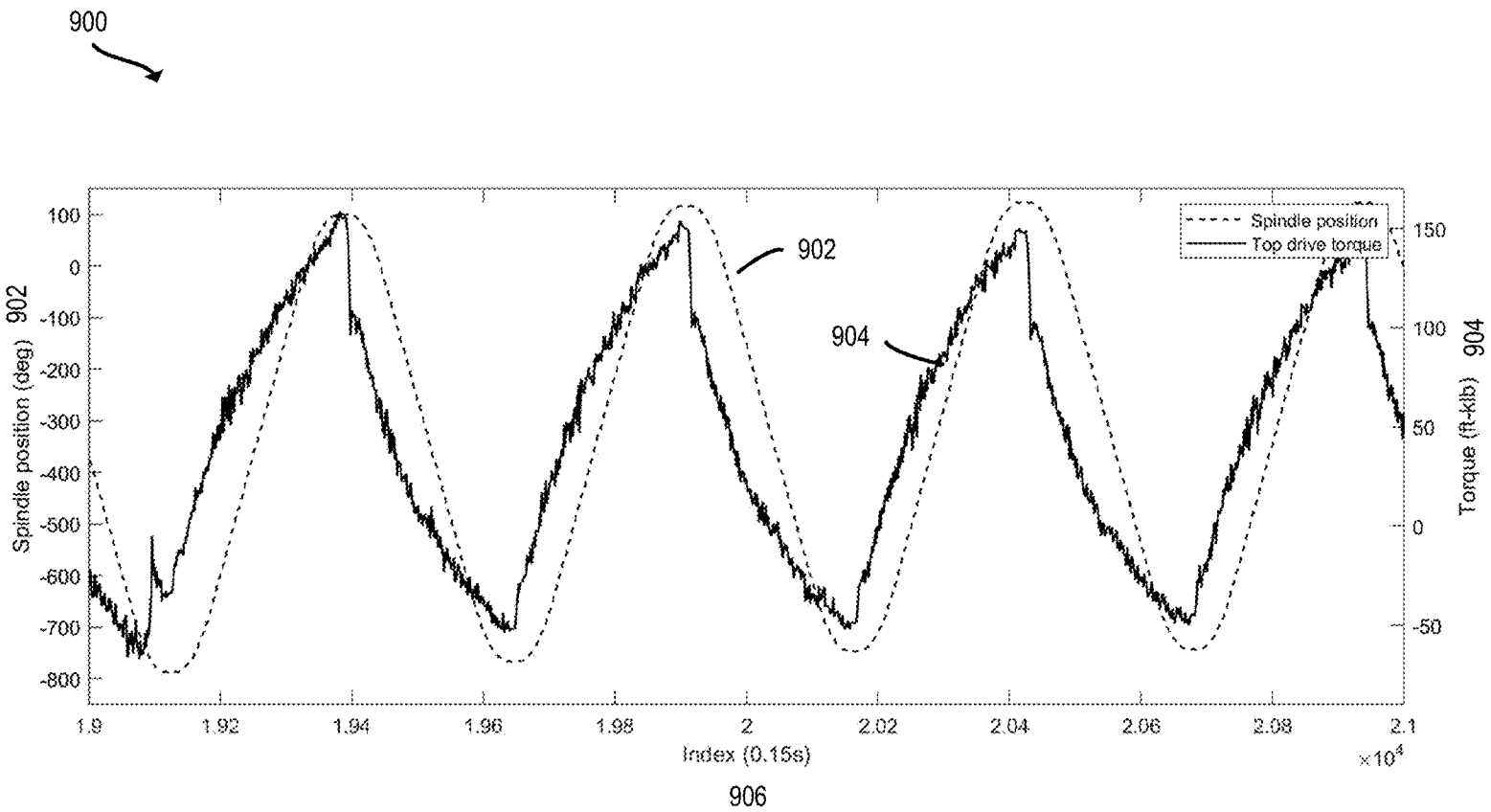
FIG. 9 is a depiction of top drive torque and spindle position over time in a drilling system.

FIG. 9 illustrates a plot 900 showing typical spindle position 902 and top drive torque 904 as a function of time 906 in a drilling system. The top drive oscillator regulates the spindle position 902 by controlling the top drive torque 904. The top drive torque 904 has a characteristic asymmetric saw-tooth pattern. When the spindle position 902 reaches its maximum or minimum position, a significant change in torque is needed to enforce a reversal in direction. Using the techniques described herein, the amount of torque needed to force the spindle into the desired position is analyzed to infer wellbore friction.

FIG. 10 illustrates an example diagram 1000 of a torque 1006 versus spindle velocity 1004 hysteresis loop 1002. The diagram 1000 shows the hysteresis loop 1002 for multiple oscillations. The loop direction is counter-clockwise. The bottom edge indicates that the spindle is transitioning from reverse direction (negative velocity) to forward direction (positive velocity). The right edge indicates increasing torque needed to move the spindle forward. The top corresponds to a slowdown in spindle velocity. At zero velocity, the downward jump in torque indicates that a significant reversal in torque is needed to cause the spindle to start rotating in reverse (e.g., to change from positive velocity to negative velocity). This "stickiness" is an indication of static friction.

FIG. 11 shows a plot 1100 of torque 1102 vs. spindle velocity 1104 illustrating measured torque 1106 vs. modeled torque 1108 across a single oscillation period. The modeled torque 1108 is given by Equation [2], above, with parameters as described above with respect to step 806 of FIG. 8. At low spindle velocity, the measured torque 1106 includes a residual component, which is not included in the torque model 1108. This difference represents a "stickiness" is due to static friction (1110, 1112). Accordingly, comparing the torque model 1108 with the measured torque 1106 over time gives the static friction (1110, 1112)

$$F_{static\ friction}=T_{topdrive\ measured}-[-T_{reactive}+k_{spring}S(t)+k_{dynamic}S'(t)] \quad [3]$$

As shown in FIG. 11, there are two friction residuals: the forward reverse static friction 1110 and the reverse static friction 1112. The maximum residual is the static friction for forward rotation 1110. The minimum residual indicates the negative of the static friction for reverse rotation 1112. The forward static friction 1110 tends to be larger in magnitude than the reverse static friction 1112 in practice. This can likely be explained by the additional torque needed to overcome reactive torque from the bit increasing the normal forces of the drill string against the walls of the wellbore, thereby increasing friction in the forward direction.

When determined from the average of the forward and reverse friction for each oscillation cycle along a wellbore, the friction estimates are relatively clean without smoothing. Thus, the friction estimates using the techniques of the present disclosure have little noise. This indicates that one can use the friction estimated from each oscillation cycle directly in real time without further pre-processing and filtering.

FIG. 12 shows a plot 1200 of torque 1202 and weight 1206 vs. measured depth (MD) 1204 illustrating the present techniques for friction computation (as indicated by asterisks 1208) as compared to friction determinations using conventional pick-up slack-off techniques (as indicated by crosses 1210). Using the pick-up slack-off technique, a difference between pick up and slack off weight divided by 2 indicates static friction. While the pick-up slack-off technique provides accurate results, it is only available when pulling off bottom and requires additional time and operator training. As seen by the asterisks 1208, the friction calculation techniques described herein provide a good correspondence with static friction from top drive torque. Accordingly, the present techniques advantageously allow for friction to be accurately monitored continuously during oscillating.

Referring to FIG. 13, one embodiment of a user interface 1350 that may be generated by steering control system 168 for monitoring and operation by a human operator is illustrated. User interface 1350 may provide many different types of information in an easily accessible format. For example, user interface 1350 may be shown on a computer monitor, a television, a viewing screen (e.g., a display device) associated with steering control system 168.

As shown in FIG. 13, user interface 1350 provides visual indicators such as a hole depth indicator 1352, a bit depth indicator 1354, a GAMMA indicator 1356, an inclination indicator 1358, an azimuth indicator 1360, and a TVD indicator 1362. Other indicators may also be provided, including a ROP indicator 1364, a mechanical specific energy (MSE) indicator 1366, a differential pressure indicator 1368, a standpipe pressure indicator 1370, a flow rate indicator 1372, a rotary RPM (angular velocity) indicator 1374, a bit speed indicator 1376, a WOB indicator 1378, and a friction indicator 1348.

In FIG. 13, at least some of indicators 1364, 1366, 1368, 1370, 1372, 1374, 1376, 1378, and 1348 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 1364 may include a marker 1365 indicating that the target value is 50 feet/hour (or 15 m/h). MSE indicator 1366 may include a marker 1367 indicating that the target value is 37 ksi (or 255 MPa). Differential pressure indicator 1368 may include a marker 1369 indicating that the target value is 200 psi (or 1.38 kPa). ROP indicator 1364 may include a marker 1365 indicating that the target value is 50 feet/hour (or 15 m/h). Standpipe pressure indicator 1370 may have no marker in the present example. Flow rate indicator 1372 may include a marker 1373 indicating that the target value is 500 gpm (or 31.5 L/s). Rotary RPM indicator 1374 may include a marker 1375 indicating that the target value is 0 RPM (e.g., due to sliding). Bit speed indicator 1376 may include a marker 1377 indicating that the target value is 150 RPM. WOB indicator 1378 may include a marker 1379 indicating that the target value is 10 klbs (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 13, a log chart 1380 may visually indicate depth versus one or more measurements (e.g., may represent log inputs relative to a progressing depth chart). For example, log chart 1380 may have a Y-axis representing depth and an X-axis representing a measurement such as GAMMA count 1381 (as shown), ROP 1383 (e.g., empirical ROP and normalized ROP), resistivity, or coefficient of friction. An autopilot button 1382 and an oscillate button 1384 may be used to control activity. For example, autopilot button 1382 may be used to engage or disengage autodriller 510, while oscillate button 1384 may be used to directly control oscillation of drill string 146 or to engage/disengage an external hardware device or controller.

In FIG. 13, a circular chart 1386 may provide current and historical toolface orientation information (e.g., which way the bend is pointed). For purposes of illustration, circular chart 1386 represents three hundred and sixty degrees. A series of circles within circular chart 1386 may represent a timeline of toolface orientations, with the sizes of the circles indicating the temporal position of each circle. For example, larger circles may be more recent than smaller circles, so a largest circle 1388 may be the newest reading and a smallest circle 1389 may be the oldest reading. In other embodiments, circles 1389, 1388 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 1386 being the most recent time and the center point being the oldest time) may be used to indicate the energy or progress (e.g., via color or patterning such as dashes or dots rather than a solid line).

In user interface 1350, circular chart 1386 may also be color coded, with the color coding existing in a band 1390 around circular chart 1386 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular toolface orientation with little deviation. As shown in user interface 1350, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 1350 to provide an intuitive summary of how narrow the standard deviation is and how much of the energy intensity is being expended in the proper direction. Furthermore, the center of energy may be viewed relative to the target. For example, user interface 1350 may clearly show that the target is at 90 degrees but the center of energy is at 45 degrees.

In user interface 1350, other indicators, such as a slide indicator 1392, may indicate how much time remains until a slide occurs or how much time remains for a current slide. For example, slide indicator 1392 may represent a time, a percentage (e.g., as shown, a current slide may be 56% complete), a distance completed, or a distance remaining. Slide indicator 1392 may graphically display information using, for example, a colored bar 1393 that increases or decreases with slide progress. In some embodiments, slide indicator 1392 may be built into circular chart 1386 (e.g., around the outer edge with an increasing/decreasing band), while in other embodiments slide indicator 1392 may be a separate indicator such as a meter, a bar, a gauge, or another indicator type. In various implementations, slide indicator 1392 may be refreshed by autoslide 514.

In user interface 1350, an error indicator 1394 may indicate a magnitude and a direction of error. For example, error indicator 1394 may indicate that an estimated drill bit position is a certain distance from the planned trajectory, with a location of error indicator 1394 around the circular chart 1386 representing the heading. For example, FIG. 13 illustrates an error magnitude of 15 feet and an error direction of 15 degrees. Error indicator 1394 may be any color but may be red for purposes of example. It is noted that error indicator 1394 may present a zero if there is no error. Error indicator may represent that drill bit 148 is on the planned trajectory using other means, such as being a green color. Transition colors, such as yellow, may be used to indicate varying amounts of error. In some embodiments, error indicator 1394 may not appear unless there is an error in magnitude or direction. A marker 1396 may indicate an ideal slide direction. Although not shown, other indicators may be present, such as a bit life indicator to indicate an estimated lifetime for the current bit based on a value such as time or distance.

It is noted that user interface 1350 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 1368 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 1368 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 1350 may provide a customizable view of various drilling processes and information for a particular individual involved in the drilling process. For example, steering control system 168 may enable a user to customize the user interface 1350 as desired, although certain features (e.g., standpipe pressure) may be locked to prevent a user from intentionally or accidentally removing important drilling information from user interface 1350. Other features and attributes of user interface 1350 may be set by user preference. Accordingly, the level of customization and the information shown by the user interface 1350 may be controlled based on who is viewing user interface 1350 and their role in the drilling process.

Figure 14:
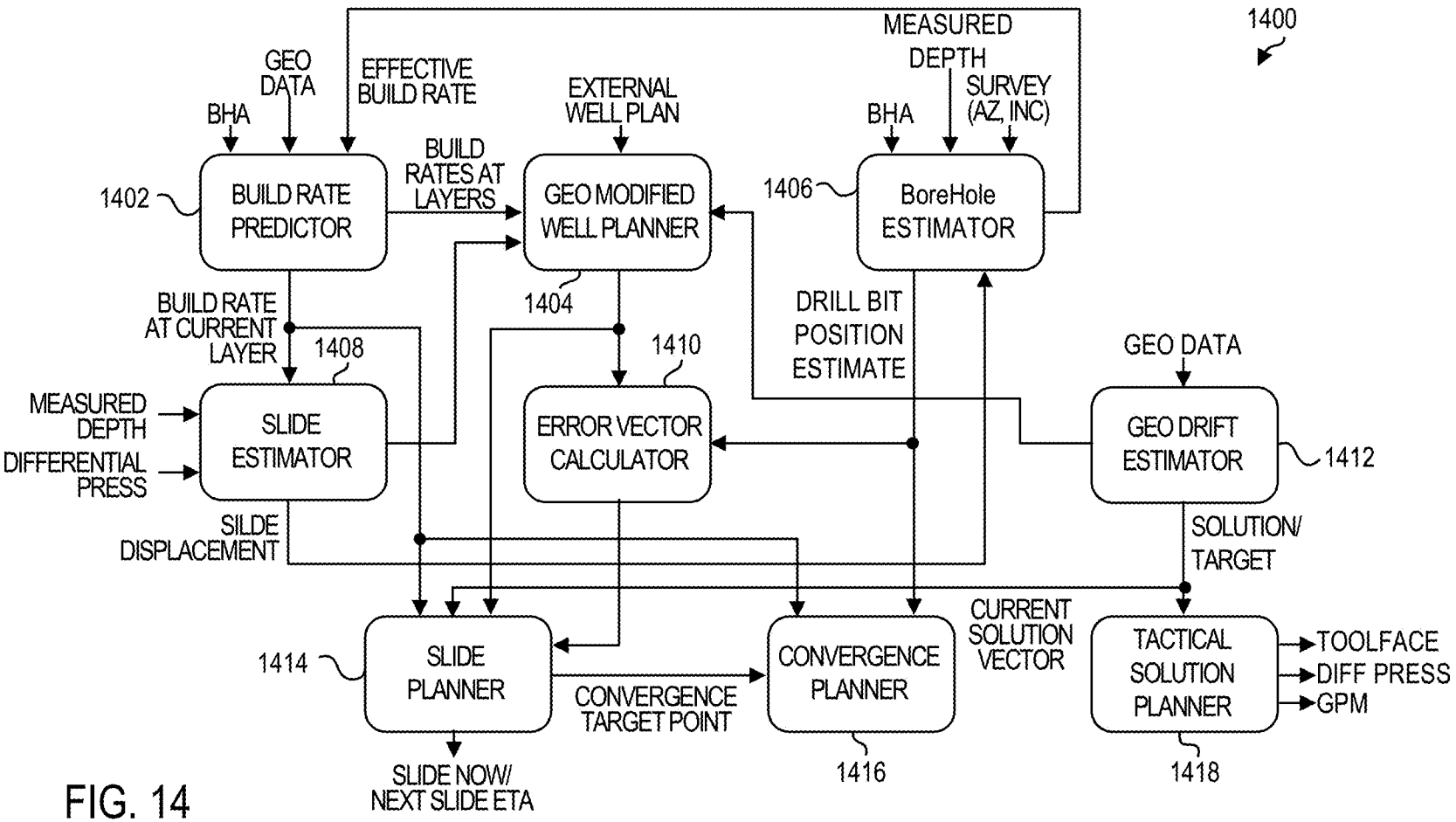
FIG. 14 is a depiction of a guidance control loop performed by the rig control systems.

Referring to FIG. 14, one embodiment of a guidance control loop (GCL) 1400 is shown in further detail GCL 1400 may represent one example of a control loop or control algorithm executed under the control of steering control system 168. GCL 1400 may include various functional modules, including a build rate predictor 1402, a geo modified well planner 1404, a borehole estimator 1406, a slide estimator 1408, an error vector calculator 1410, a geological drift estimator 1412, a slide planner 1414, a convergence planner 1416, and a tactical solution planner 1418. In the following description of GCL 1400, the term "external input" refers to input received from outside GCL 1400, while "internal input" refers to input exchanged between functional modules of GCL 1400.

In FIG. 14, build rate predictor 1402 receives external input representing BHA information and geological information, receives internal input from the borehole estimator 1406, and provides output to geo modified well planner 1404, slide estimator 1408, slide planner 1414, and convergence planner 1416. Build rate predictor 1402 is configured to use the BHA information and geological information to predict drilling build rates of current and future sections of borehole 106. For example, build rate predictor 1402 may determine how aggressively a curve will be built for a given formation with BHA 149 and other equipment parameters.

In FIG. 14, build rate predictor 1402 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good toolface and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 1402 may calculate BHA orientation to account for formation transitions. Within a single strata layer, build rate predictor 1402 may use the BHA orientation to account for internal layer characteristics (e.g., grain) to determine build rates for different parts of a strata layer. The BHA information may include bit characteristics, mud motor bend setting, stabilization and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 1402 may also be used to plan convergence adjustments and confirm in advance of drilling that targets can be achieved with current parameters.

In FIG. 14, geo modified well planner 1404 receives external input representing a well plan, internal input from build rate predictor 1402 and geo drift estimator 1412, and provides output to slide planner 1414 and error vector calculator 1410. Geo modified well planner 1404 uses the input to determine whether there is a more desirable trajectory than that provided by the well plan, while staying within specified error limits. More specifically, geo modified well planner 1404 takes geological information (e.g., drift) and calculates whether another trajectory solution to the target may be more efficient in terms of cost or reliability. The outputs of geo modified well planner 1404 to slide planner 1414 and error vector calculator 1410 may be used to calculate an error vector based on the current vector to the newly calculated trajectory and to modify slide predictions. In some embodiments, geo modified well planner 1404 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 1404 may then treat the target as a vector target, while remaining within the error limits of the original well plan. In some embodiments, geo modified well planner 1404 may be an optional module that is not used unless the well plan is to be modified. For example, if the well plan is marked in steering control system 168 as non-modifiable, geo modified well planner 1404 may be bypassed altogether or geo modified well planner 1404 may be configured to pass the well plan through without any changes.

In FIG. 14, borehole estimator 1406 may receive external inputs representing BHA information, measured depth information, survey information (e.g., azimuth and inclination), and may provide outputs to build rate predictor 1402, error vector calculator 1410, and convergence planner 1416. Borehole estimator 1406 may be configured to provide an estimate of the actual borehole and drill bit position and trajectory angle without delay, based on either straight line projections or projections that incorporate sliding. Borehole estimator 1406 may be used to compensate for a sensor being physically located some distance behind drill bit 148 (e.g., 50 feet) in drill string 146, which makes sensor readings lag the actual bit location by 50 feet. Borehole estimator 1406 may also be used to compensate for sensor measurements that may not be continuous (e.g., a sensor measurement may occur every 100 feet). Borehole estimator 1406 may provide the most accurate estimate from the surface to the last survey location based on the collection of survey measurements. Also, borehole estimator 1406 may take the slide estimate from slide estimator 1408 (described below) and extend the slide estimate from the last survey point to a current location of drill bit 148. Using the combination of these two estimates, borehole estimator 1406 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 14, slide estimator 1408 receives external inputs representing measured depth and differential pressure information, receives internal input from build rate predictor 1402, and provides output to borehole estimator 1406 and geo modified well planner 1404. Slide estimator 1408 may be configured to sample toolface orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 1400, using slide estimator 1408, each toolface update may be algorithmically merged with the average differential pressure of the period between the previous and current toolface readings, as well as the MD change during this period to predict the direction, angular deviation, and MD progress during the period. As an example, the periodic rate may be between 10 and 60 seconds per cycle depending on the toolface update rate of downhole tool 166. With a more accurate estimation of the slide effectiveness, the sliding efficiency can be improved. The output of slide estimator 1408 may accordingly be periodically provided to borehole estimator 1406 for accumulation of well deviation information, as well to geo modified well planner 1404. Some or all of the output of the slide estimator 1408 may be output to an operator, such as shown in the user interface 1350 of FIG. 13.

In FIG. 14, error vector calculator 1410 may receive internal input from geo modified well planner 1404 and borehole estimator 1406. Error vector calculator 1410 may be configured to compare the planned well trajectory to an actual borehole trajectory and drill bit position estimate. Error vector calculator 1410 may provide the metrics used to determine the error (e.g., how far off) the current drill bit position and trajectory are from the well plan. For example, error vector calculator 1410 may calculate the error between the current bit position and trajectory to the planned trajectory and the desired bit position. Error vector calculator 1410 may also calculate a projected bit position/projected trajectory representing the future result of a current error.

In FIG. 14, geological drift estimator 1412 receives external input representing geological information and provides outputs to geo modified well planner 1404, slide planner 1414, and tactical solution planner 1418. During drilling, drift may occur as the particular characteristics of the formation affect the drilling direction. More specifically, there may be a trajectory bias that is contributed by the formation as a function of ROP and BHA 149. Geological drift estimator 1412 is configured to provide a drift estimate as a vector that can then be used to calculate drift compensation parameters that can be used to offset the drift in a control solution.

In FIG. 14, slide planner 1414 receives internal input from build rate predictor 1402, geo modified well planner 1404, error vector calculator 1410, and geological drift estimator 1412, and provides output to convergence planner 1416 as well as an estimated time to the next slide. Slide planner 1414 may be configured to evaluate a slide/drill ahead cost calculation and plan for sliding activity, which may include factoring in BHA wear, expected build rates of current and expected formations, and the well plan trajectory. During drill ahead, slide planner 1414 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 1414 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 14, slide planner 1414 may also look at the current position relative to the next connection. A connection may happen every 140 to 100 feet (or some other distance or distance range based on the particulars of the drilling operation) and slide planner 1414 may avoid planning a slide when close to a connection or when the slide would carry through the connection. For example, if the slide planner 1414 is planning a 50 foot slide but only 20 feet remain until the next connection, slide planner 1414 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the toolface before finishing the slide. During slides, slide planner 1414 may provide some feedback as to the progress of achieving the desired goal of the current slide. In some embodiments, slide planner 1414 may account for reactive torque in the drill string. More specifically, when rotating is occurring, there is a reactional torque wind up in drill string 146. When the rotating is stopped, drill string 146 unwinds, which changes toolface orientation and other parameters. When rotating is started again, drill string 146 starts to wind back up. Slide planner 1414 may account for the reactional torque so that toolface references are maintained, rather than stopping rotation and then trying to adjust to a desired toolface orientation. While not all downhole tools may provide toolface orientation when rotating, using one that does supply such information for GCL 1400 may significantly reduce the transition time from rotating to sliding.

In FIG. 14, convergence planner 1416 receives internal inputs from build rate predictor 1402, borehole estimator 1406, and slide planner 1414, and provides output to tactical solution planner 1418. Convergence planner 1416 is configured to provide a convergence plan when the current drill bit position is not within a defined margin of error of the planned well trajectory. The convergence plan represents a path from the current drill bit position to an achievable and desired convergence target point along the planned trajectory. The convergence plan may take account the amount of sliding/drilling ahead that has been planned to take place by slide planner 1414. Convergence planner 1416 may also use BHA orientation information for angle of attack calculations when determining convergence plans as described above with respect to build rate predictor 1402. The solution provided by convergence planner 1416 defines a new trajectory solution for the current position of drill bit 148. The solution may be immediate without delay, or planned for implementation at a future time that is specified in advance.

In FIG. 14, tactical solution planner 1418 receives internal inputs from geological drift estimator 1412 and convergence planner 1416, and provides external outputs representing information such as toolface orientation, differential pressure, and mud flow rate. Tactical solution planner 1418 is configured to take the trajectory solution provided by convergence planner 1416 and translate the solution into control parameters that can be used to control drilling rig 210. For example, tactical solution planner 1418 may convert the solution into settings for control systems 522, 524, 525, and 526 to accomplish the actual drilling based on the solution. Tactical solution planner 1418 may also perform performance optimization to optimizing the overall drilling operation as well as optimizing the drilling itself (e.g., how to drill faster).

Other functionality may be provided by GCL 1400 in additional modules or added to an existing module. For example, there is a relationship between the rotational position of the drill pipe on the surface and the orientation of the downhole toolface. Accordingly, GCL 1400 may receive information corresponding to the rotational position of the drill pipe on the surface. GCL 1400 may use this surface positional information to calculate current and desired toolface orientations. These calculations may then be used to define control parameters for adjusting the top drive 140 to accomplish adjustments to the downhole toolface in order to steer the trajectory of borehole 106.

For purposes of example, an object-oriented software approach may be utilized to provide a class-based structure that may be used with GCL 1400 or other functionality provided by steering control system 168. In GCL 1400, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active well plan, and control limits. The drilling model class may produce a control output solution and may be executed via a main processing loop that rotates through the various modules of GCL 1400. The drill bit model may represent the current position and state of drill bit 148. The drill bit model may include a three dimensional (3D) position, a drill bit trajectory, BHA information, bit speed, and toolface (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum RPMs to the defined level. The control output solution may represent the control parameters for drilling rig 210.

Each functional module of GCL 1400 may have behavior encapsulated within a respective class definition. During a processing window, the individual functional modules may have an exclusive portion in time to execute and update the drilling model. For purposes of example, the processing order for the functional modules may be in the sequence of geo modified well planner 1404, build rate predictor 1402, slide estimator 1408, borehole estimator 1406, error vector calculator 1410, slide planner 1414, convergence planner 1416, geological drift estimator 1412, and tactical solution planner 1418. It is noted that other sequences may be used in different implementations.

In FIG. 14, GCL 1400 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 15, a block diagram illustrating selected elements of an embodiment of a controller 1500 for performing surface steering according to the present disclosure. In various embodiments, controller 1500 may represent an implementation of steering control system 168. In other embodiments, at least certain portions of controller 1500 may be used for control systems 510, 512, 514, 522, 524, 525, and 526 (see FIG. 5).

In the embodiment depicted in FIG. 15, controller 1500 includes processor 1501 coupled via shared bus 1502 to storage media collectively identified as memory media 1510.

Controller 1500, as depicted in FIG. 15, further includes network adapter 1520 that interfaces controller 1500 to a network (not shown in FIG. 15). In embodiments suitable for use with user interfaces, controller 1500, as depicted in FIG. 15, may include peripheral adapter 1506, which provides connectivity for the use of input device 1508 and output device 1509. Input device 1508 may represent a device for user input, such as a keyboard or a mouse, or even a video camera. Output device 1509 may represent a device for providing signals or indications to a user, such as loudspeakers for generating audio signals.

Controller 1500 is shown in FIG. 15 including display adapter 1504 and further includes a display device 1505. Display adapter 1504 may interface shared bus 1502, or another bus, with an output port for one or more display devices, such as display device 1505. Display device 1505 may be implemented as a liquid crystal display screen, a computer monitor, a television or the like. Display device 1505 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1505 may include an output device 1509, such as one or more integrated speakers to play audio content, or may include an input device 1508, such as a microphone or video camera.

In FIG. 15, memory media 1510 encompasses persistent and volatile media, fixed and removable media, and magnetic and semiconductor media. Memory media 1510 is operable to store instructions, data, or both. Memory media 1510 as shown includes sets or sequences of instructions 1524-2, namely, an operating system 1512 and surface steering control 1514. Operating system 1512 may be a UNIX or UNIX-like operating system, a Windows® family operating system, or another suitable operating system. Instructions 1524 may also reside, completely or at least partially, within processor 1501 during execution thereof. It is further noted that processor 1501 may be configured to receive instructions 1524-1 from instructions 1524-2 via shared bus 1502. In some embodiments, memory media 1510 is configured to store and provide executable instructions for executing GCL 1400, as mentioned previously, among other methods and operations disclosed herein.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A drilling system comprising:

a drill string for drilling a borehole;

a top drive coupled to the drill string to provide torque to the drill string;

a casing disposed around the drill string;

one or more processors; and a memory coupled to the one or more processors, the memory comprising code configured to cause the one or more processors to transmit signals causing a method comprising:

applying oscillatory angular movement at the top of the drill string or the casing;

measuring a torque applied to the drill string and an angular position of the drill string or the casing;

based on the measured torque and the measured angular position, computing a friction between the borehole and the drill string or the casing, wherein computing the friction comprises:

based on the measured torque and the measured angular position, identifying a modeled torque comprising a reactive torque, a spring torque, and a dynamic torque, and determining the friction from a residual between the measured torque and the modeled torque; and based on the computed friction, performing an action resulting in modified operation of the drilling system.

2. The drilling system of claim 1, wherein computing the friction comprises fitting a model to the measured torque to infer one or more of the reactive torque, the spring torque, the dynamic torque, a forward static friction, a reverse static friction, or an average static friction.

3. The drilling system of claim 1, wherein taking the action comprises one or more of:

optimizing a toolface control in sliding;

using changes in the friction to identify and mitigate hole cleaning issues, stuck pipe, or tortuosity;

using the computed friction to optimize weight on bit and rate of penetration;

using the computed friction to apply a modified torque on a bottom hole assembly during rotary drilling;

displaying a visualization of the measured torque and the computed friction on a display of the drilling system; or transmitting an alert to an operator.

4. The drilling system of claim 1, wherein the torque is measured using a sensor positioned between the top drive and the drill string or the torque is estimated in the top drive based on a measured current.

5. The drilling system of claim 1, wherein the torque is applied to the drill string and measured via the top drive, the drill string, a quill coupled to the top drive, or a saver sub coupled to the top drive.

6. The drilling system of claim 1, the method further comprising:

measuring the torque and the angular position at a plurality of times for a plurality of depths of the borehole; and computing a corresponding plurality of friction values, wherein the action is based on the plurality of friction values as a function of the respective plurality of depths.

7. The drilling system of claim 1, wherein:

computing the friction between the borehole and the drill string or casing comprises computing one or more of: a forward static friction, a reverse static friction, or an average static friction.

8. The drilling system of claim 1, the method further comprising:

determining that the friction exceeds a threshold or a target range is not satisfied, wherein the action is performed responsive to determining that the friction exceeds the threshold or the target range is not satisfied.

9. The drilling system of claim 1, wherein:

applying the oscillatory angular movement comprises varying both a speed and an amplitude of the top drive;

the method further comprising:

obtaining a plurality of values of torque changes for each of the plurality of speeds and amplitudes of the top drive; and generating a profile of friction at depth along a portion of the borehole responsive to the plurality of values of torque changes.

10. A method for determining friction in a borehole comprising:

during drilling of the borehole, applying, by a drilling system, oscillatory angular movement at the top of a drill string or a casing in the drilling system;

measuring, by the drilling system during the drilling of the borehole, a torque applied to the drill string and an angular position of the drill string or the casing;

based on the measured torque and the measured angular position, computing, by the drilling system during the drilling of the borehole, a friction between the borehole and the drill string or the casing, wherein computing the friction comprises:

based on the measured torque and the measured angular position, identifying a modeled torque comprising a reactive torque, a spring torque, and a dynamic torque, and determining the friction from a residual between the measured torque and the modeled torque; and based on the computed friction, performing, by the drilling system during the drilling of the borehole, an action resulting in modified operation of the drilling system.

11. The method of claim 10, wherein computing the friction comprises fitting a model to the measured torque to infer one or more of: the reactive torque, the spring torque, the dynamic torque, a forward static friction, a reverse static friction, or an average static friction.

12. The method of claim 10, wherein taking the action comprises one or more of:

optimizing a toolface control in sliding;

using changes in the friction to identify and mitigate hole cleaning issues, stuck pipe, or tortuosity;

using the computed friction to optimize weight on bit and rate of penetration; or using the computed friction to apply a modified torque on a bottom hole assembly during rotary drilling;

displaying the measured torque and the computed friction on a display of the drilling system; or transmitting an alert to an operator.

13. The method of claim 10, wherein the torque is measured using a sensor positioned between a top drive in the drilling system and the drill string or the torque is estimated in the top drive based on a measured current.

14. The method of claim 10, further comprising:

measuring the torque and the angular position at a plurality of times for a plurality of depths of the borehole; and computing a corresponding plurality of friction values, wherein the action is based on the plurality of friction values as a function of the respective plurality of depths.

15. The method of claim 10, further comprising:

determining that the friction exceeds a threshold or a target range is not satisfied, wherein the action is performed responsive to determining that the friction exceeds the threshold or the target range is not satisfied.

16. The method of claim 10, wherein:

computing the friction between the borehole and the drill string or casing comprises computing one or more of: a forward static friction, a reverse static friction, or an average static friction.

17. The method of claim 10, further comprising:

obtaining a plurality of values of torque changes for each of the plurality of speeds and amplitudes of a top drive in the drilling system; and generating a profile of friction at a set of depths along a portion of the borehole responsive to the plurality of values of torque changes.

18. A non-transitory computer-readable medium comprising code configured to cause one or more processors to transmit signals causing a method comprising:

during drilling of a borehole, applying, by a drilling system, oscillatory angular movement at the top of a drill string or a casing in the drilling system;

measuring, by the drilling system during the drilling of the borehole, a torque applied to the drill string and an angular position of the drill string or the casing;

based on the measured torque and the measured angular position, computing, by the drilling system during the drilling of the borehole, a friction between a well bore and the drill string or the casing, wherein computing the friction comprises:

based on the measured torque and the measured angular position, identifying a modeled torque comprising a reactive torque, a spring torque, and a dynamic torque, and determining the friction from a residual between the measured torque and the modeled torque; and based on the computed friction, performing, by the drilling system during the drilling of the borehole, an action resulting in modified operation of the drilling system.

* * * * *